US010145037B2

(12) United States Patent
Davis et al.

(10) Patent No.: US 10,145,037 B2
(45) Date of Patent: Dec. 4, 2018

(54) MULTI-CARRIER, ZONAL WEAVING SYSTEM, METHOD, AND MATERIAL

(71) Applicant: NIKE, Inc., Beaverton, OR (US)

(72) Inventors: Carrie L. Davis, Portland, OR (US); Megan Foley, Portland, OR (US); William C. McFarland, II, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/416,947

(22) Filed: Jan. 26, 2017

(65) Prior Publication Data

US 2017/0218541 A1 Aug. 3, 2017

Related U.S. Application Data

(60) Provisional application No. 62/288,173, filed on Jan. 28, 2016.

(51) Int. Cl.
*D03D 13/00* (2006.01)
*D03D 31/00* (2006.01)
(Continued)

(52) U.S. Cl.
CPC ..... *D03D 13/00* (2013.01); *D03D 13/004* (2013.01); *D03D 31/00* (2013.01); *D03D 47/14* (2013.01)

(58) Field of Classification Search
CPC .... D03D 13/00; D03D 35/00; D03D 2700/10; D03D 25/00; D03D 47/42; D03D 11/02; D03D 19/00; D03D 31/00; D03D 47/06
See application file for complete search history.

(56) References Cited

U.S. PATENT DOCUMENTS 3,861,427 A * 1/1975 Scheidecker ..... D03D 47/23 139/448
3,948,297 A * 4/1976 Doriguzzi ..... D03D 47/00 139/443
(Continued)

FOREIGN PATENT DOCUMENTS

CH 682289 A5 8/1993
CN 202347194 U 7/2012
(Continued)

OTHER PUBLICATIONS

International Search Report and Written Opinion dated May 10, 2017 in International Patent Application No. PCT/US2017/015132, 16 pages.

*Primary Examiner* — Bobby Muromoto, Jr.
(74) *Attorney, Agent, or Firm* — Shook, Hardy and Bacon LLP

(57) ABSTRACT

A multi-carrier, zonal weaving system and method of manufacturing a zonal woven material is provided. The multi-carrier system includes a first weft yarn, a second weft yarn, and one or more intermediate warp yarns for wrapping by the first and second weft yarns. The zonal weaving method includes receiving a first weft yarn from a first origin via a first shed, wrapping it around one or more zonal warp yarns, and returned to the first weft origin after the first shed upper and lower yarns are exchanged. In further aspects, a second weft yarn is received from a second weft origin via a second shed, wrapped around the same intermediate, zonal warp yarns, and returned to the second weft origin after exchange of the second shed yarns. In one aspect, the first and second weft yarns are interlocked during wrapping of the common warp yarns.

17 Claims, 23 Drawing Sheets

(51) Int. Cl.
*D03D 47/14* (2006.01)
*D03D 25/00* (2006.01)

(56) References Cited

U.S. PATENT DOCUMENTS

| | | | | | |
|---|---|---|---|---|---|
| 4,004,617 | A * | 1/1977 | Spence | D03D 35/00 | 139/416 |
| 4,073,320 | A * | 2/1978 | Spence | D03D 35/00 | 139/383 R |
| 4,077,437 | A * | 3/1978 | Spence | D03D 35/00 | 139/116.1 |
| 4,243,076 | A | 1/1981 | Mallard et al. | | |
| 4,421,142 | A * | 12/1983 | Muller | D03D 13/00 | 139/117 |
| 4,614,210 | A | 9/1986 | Debaes | | |
| 5,241,994 | A | 9/1993 | Guenther et al. | | |
| 5,783,278 | A | 7/1998 | Nishimura et al. | | |
| 6,056,479 | A | 5/2000 | Stevenson et al. | | |
| 6,186,185 | B1 | 2/2001 | Khokar | | |
| 6,338,367 | B1 | 1/2002 | Khokar | | |
| 7,111,647 | B2 | 9/2006 | Debaes | | |
| 7,240,698 | B2 | 7/2007 | Debaes | | |
| 7,395,839 | B2 | 7/2008 | Debaes | | |
| 7,621,297 | B2 | 11/2009 | Debaes | | |
| 7,992,596 | B2 | 8/2011 | Khokar | | |
| 8,129,294 | B2 | 3/2012 | Khokar | | |
| 2003/0116218 | A1* | 6/2003 | Khokar | D03D 41/004 | 139/11 |
| 2005/0161104 | A1* | 7/2005 | Reiter | D03D 1/0005 | 139/383 R |
| 2017/0198424 | A1* | 7/2017 | Alex | D03D 13/00 | |
| 2017/0218541 | A1* | 8/2017 | Davis | D01H 13/302 | |

FOREIGN PATENT DOCUMENTS

| | | | |
|---|---|---|---|
| DE | 2552094 | A1 | 6/1976 |
| DE | 3042368 | A1 | 5/1981 |
| DE | 4204014 | A1 | 8/1993 |
| DE | 202012007416 | U1 | 9/2012 |
| GB | 1553575 | A | 9/1979 |
| WO | 9713899 | A1 | 4/1997 |

* cited by examiner

2300

| | | | | | | | | | | | | | |
|---|---|---|---|---|---|---|---|---|---|---|---|---|---|
| 1 | A | A | A | A | A | A | A | A | A | A | A | A | A |
| 2 | A | A | A | ~~A~~<br>~~B~~→ | ~~A~~<br>~~B~~ | A<br>b | A<br>b | A<br>b | ~~A~~<br>~~B~~ | ~~A~~←<br>~~B~~ | B | B | B |
| 3 | A | A | ~~A~~<br>~~B~~→ | ~~A~~<br>~~B~~ | ~~A~~<br>~~B~~ | ~~A~~<br>~~B~~ | A<br>b | ~~A~~<br>~~B~~ | ~~A~~<br>~~B~~ | ~~A~~<br>~~B~~ | ~~A~~←<br>~~B~~ | B | B |
| 4 | A | A | ~~A~~<br>~~B~~→ | ~~A~~<br>~~B~~ | ~~A~~<br>~~B~~ | ~~A~~<br>~~B~~ | A<br>b | ~~A~~<br>~~B~~ | ~~A~~<br>~~B~~ | ~~A~~<br>~~B~~ | ~~A~~←<br>~~B~~ | B | B |
| 5 | A | A | A | ~~A~~<br>~~B~~→ | ~~A~~<br>~~B~~ | A<br>b | A<br>b | A<br>b | ~~A~~<br>~~B~~ | ~~A~~←<br>~~B~~ | B | B | B |
| 6 | A | A | A | A | A | A | A | A | A | A | A | A | A |

*FIG. 23.*

2400

| | | | | | | | | | | | | | |
|---|---|---|---|---|---|---|---|---|---|---|---|---|---|
| 1 | A | A | A | A | A | A | A | A | A | A | A | A | A |
| 2 | A | A | A | A<br>C→ | A←<br>C | C | C | C | →B<br>C | B←<br>C← | B | B | B |
| 3 | A | A | A<br>C→ | A<br>C | A<br>C | A←<br>C | C | →B<br>C | B<br>C | B<br>C | B<br>C← | B | B |
| 4 | A | A | A<br>C→ | A<br>C | A<br>C | A←<br>C | C | →B<br>C | A<br>C | A<br>C | A<br>C← | B | B |
| 5 | A | A | A | A<br>C→ | A←<br>C | C | C | C | →B<br>C | B<br>C← | B | B | B |
| 6 | A | A | A | A | A | A | A | A | A | A | A | A | A |

*FIG. 24.*

MULTI-CARRIER, ZONAL WEAVING SYSTEM, METHOD, AND MATERIAL

PRIORITY CLAIM

This application claims priority to U.S. Provisional Patent Application No. 62/288,173, filed Jan. 28, 2016, entitled "Multi-Carrier, Zonal Weaving System, Method, and Material," the entire contents of which is hereby incorporated by reference.

TECHNICAL FIELD

This technology relates to a woven material having a zone with multiple weft yarns. Additional aspects comprise a multiple carrier system for generating a woven material with a common warp zone wrapped by multiple weft yarns.

BACKGROUND

In traditional weaving practice, a weft yarn may be carried across the entire width of a series of warp yarns providing a shed. While the fiber content of the weft yarn may be changed across the entire shed, there is little ability to alter the resulting structure of the woven material within rows of weaving or at intermediate portions of the woven fabric. The resulting fabric, therefore, may have a consistent appearance with minimal variation in characteristics across the width of the fabric. While maintaining a common weft yarn across the width of the material, the material itself is not configured to incorporate any particular zones of performance or targeted material properties.

Additionally, in some weaving systems, multiple carriers may be used to transfer a common weft yarn across an entire width of a shed. But in such systems, the handoff between multiple carriers relates to transporting a single weft yarn for weaving. Consequently, warp yarns on opposite sides of the open shed have minimal interaction with each other and with the single weft yarn carried throughout the fabric, which precludes the creation of zonal features integrated within the woven fabric, such as a common warp zone wrapped by multiple weft yarns.

SUMMARY

Aspects hereof are defined by the claims below, not this summary. The following high-level overview of various aspects provides an overview of the disclosure and introduces a selection of concepts that are further described in the detailed description section below. This summary is not intended to identify key features or essential features of the claimed subject matter, nor is it intended to be used as an aid in isolation to determine the scope of the claimed subject matter.

In brief and at a high level, this disclosure describes, among other things, a multi-carrier (e.g., a double-carrier), zonal weaving system and method of manufacturing a zonal woven material. In one aspect, the multi-carrier system includes a first carrier that enters a shed of warp yarns from a first side of the material (e.g., a left carrier entering from a left side of the shed) and wraps a first weft yarn around a central and/or intermediate warp yarn or yarns. In aspects described herein, an intermediate warp yarn or a group of intermediate warp yarns may be referred to as an "intermediate warp zone" or a common warp zone that is wrapped by multiple weft yarns to provide a zonal woven feature. In the same step, or in a previous or subsequent step, a second carrier enters the shed of warp yarns from a second side of the material (e.g., a right carrier entering from a right side of the shed) and wraps a second weft yarn around the same intermediate warp zone (i.e., the same intermediate warp yarns wrapped by the first weft yarn). The intermediate warp zone may now include, at each row of weaving, both the first and second weft yarns wrapped around the same warp yarns.

Based on incorporating dual-carrier weft yarns, the zonal weaving system generates the intermediate warp zone without the use of an external yarn not woven within the fabric, such as an embroidered feature on the surface of the woven material that is not integrated into the adjacent portions of the warp shed. In one aspect, the intermediate warp zone is created from a currently active, first weft yarn being woven across the entire fabric shed, and the incorporation of a second active weft yarn woven to "meet" the first yarn where the intermediate warp zone is created. In this example, both the first and second weft yarns are woven within the fabric shed prior to meeting and wrapping around the common warp yarns of the intermediate warp zone. By utilizing the woven weft yarns in both the adjacent warp sheds and in the zonal wrapped portion, a spacing, holes, gaps or other transitional characteristics are prevented and/or minimized in the woven boundary material directly adjacent the intermediate warp zone. In other words, the transition between adjacent woven sheds and the intermediate wrapped zone may be optimized by generating the wrapped zone from active, woven weft yarns. Additionally, instead of an isolated, embroidered feature on the surface of a material, the integrated, intermediate warp zone may be formed with actively woven weft yarns wrapping around the zonal feature being seamlessly created within the fabric, as further described in aspects below.

In some aspects, the first and second weft yarns may be linked together during wrapping, such as by interlocking the second weft yarn of the second carrier with a loop of the first weft yarn from the first carrier. As such, the linkage between first and second weft yarns, with both well yarns wrapped around the same intermediate warp zone, may hold the intermediate warp yarn in place while creating equilibrium of tensile forces within the woven fabric, in some aspects. Additionally, in some aspects, while maintaining tension across multiple weft yarns and along the warp yarns in the intermediate warp zone, the resulting zonal woven fabric maintains one or more consistent characteristics throughout a change in boundaries of the intermediate warp zone, such as during changes between narrower and wider zonal features. Further, with multiple rows of overlapping and/or interlocking warp yarns within the intermediate warp zone, the resulting zonal woven material may include a visible and/or tactile zonal characteristic where both weft yarns are utilized in the intermediate warp zone.

In further aspects, the number of wrapped yarns within an intermediate warp zone may vary to provide a common warp zone having a particular shape, orientation, dimension, location, or other characteristic within the woven material. In one aspect, the intermediate warp zone includes a single warp yarn wrapped by both the first weft and second weft yarns via the first and second carriers. In another aspect, the intermediate warp zone includes multiple warp yarns that are collectively wrapped by both the first and second weft yarns via the first and second carriers. The group of multiple warp yarns collectively wrapped by the first and second wefts may provide a common warp zone of a particular width within the woven material. In some aspects, a common warp zone may be dynamically positioned within the woven material based on a placement of the intermediate warp yarn (or yarns) with respect to the adjacent warp yarns forming the shed of the woven material. As such, the width of the intermediate warp zone may remain constant across multiple rows of weaving, or may change according to a particular pattern or number of rows with varying numbers of warp yarns included in the intermediate warp zone. Based on such changes, one or more zones of performance may be woven within the material, and the intermediate warp zone may provide zonal placement according to a particular patterns and desired properties within the woven fabric, as depicted in examples below.

For example, a woven footwear upper may include a zonal woven characteristic that is integrated within the woven material utilizing the weft yarns that meet and wrap in a common, intermediate warp zone. Such zones may provide additional structure to the form of the upper, a reinforced thickness to a particular high-wear portion of the shoe, or even a visible appearance corresponding to a particular zonal placement. In another example, for a woven apparel item utilizing the multi-carrier, zonal weaving system, the zonal properties of dynamic, intermediate warp zones may be incorporated in particular locations on a garment, such as a zone of performance for a particular athletic garment. In one aspect, an intermediate warp zone may be woven within an apparel fabric to provide structure to a shoulder portion, an enhanced thickness on a reinforced elbow, or a modesty zone within a woven front. In further aspects of a zonal woven material, utilizing aspects of the multi-carrier, zonal woven system described herein, different zones of performance providing specific properties may be woven within the material at a particular locations, without dropping in or splicing additional yarns, carrying or floating supplemental yarns, or otherwise adding to the bulk of the garment or to the finishing process involved in the material construction.

DESCRIPTION OF THE DRAWINGS

Illustrative aspects are described in detail below with reference to the attached drawing figures, and wherein:

FIG. 23 is a chart of a series of active and inactive weft yarn insertions that may occur across an x-axis of the fabric in accordance with aspects herein to provide the selective zonal characteristics; and FIG. 24 is another chart of a series of active and inactive weft yarn insertions that may occur across an x-axis of the fabric in accordance with aspects herein to provide the selective zonal characteristics.

DETAILED DESCRIPTION

Figure 1:
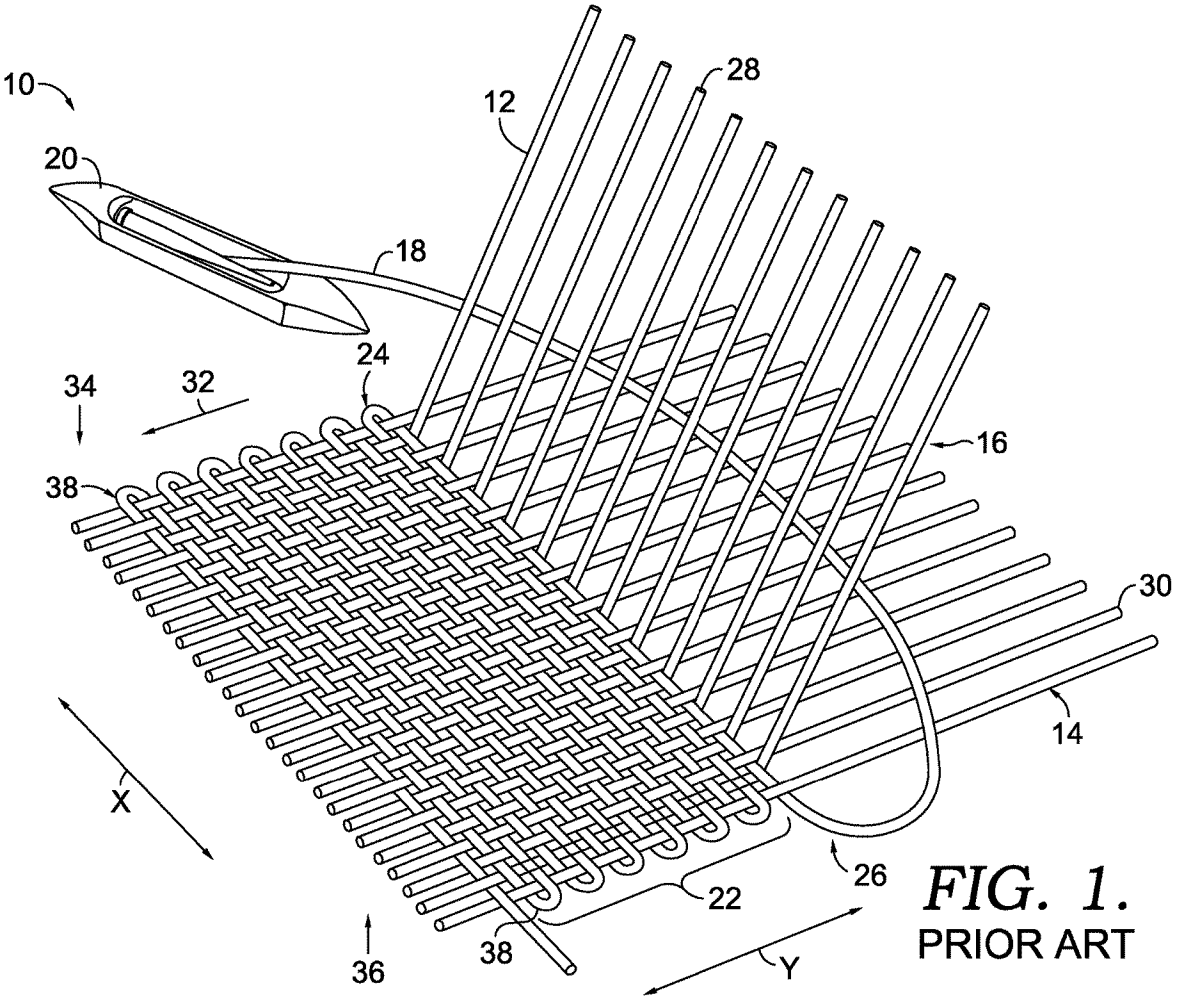
FIG. 1. PRIOR ART
FIG. 1 is a perspective view of an exemplary prior art weaving system.

The subject matter is described with specificity herein to meet statutory requirements, but the description itself is not intended to necessarily limit the scope of the claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Aspects hereof are directed to a multi-carrier (e.g., double-carrier), zonal weaving system and method of manufacturing a zonal woven material. In one aspect, the multi-carrier system includes a first carrier that enters a shed of warp yarns from a first side of the material and wraps a first weft yarn around an intermediate warp yarn (or yarns). In the same step, or in a previous or subsequent step, a second carrier enters the shed of warp yarns from a second side of the material and wraps a second weft yarn around the same intermediate warp yarn(s). In further aspects, the first and second weft yarns may be linked together during wrapping, such as by linking the second weft yarn of the second carrier with the loop of the first weft yarn from the first carrier. As such, the linkage between first and second weft yarns, with both weft yarns wrapped around the same intermediate warp yarn(s), may hold the intermediate warp yarn(s) in place while creating equilibrium of tensile forces within the woven fabric, in some aspects.

In further aspects, the number of intermediate warp yarns may vary to provide a common warp zone having a particular design and/or structure within the woven material. In one aspect, the intermediate warp yarn is a single warp yarn wrapped by both the first weft and second weft yarns via the first and second carriers. In another aspect, the intermediate warp yarn includes multiple warp yarns that are collectively wrapped by both the first and second weft yarns via the first and second carriers. The group of multiple warp yarns collectively wrapped by the first and second wefts may provide a common and/or intermediate warp zone within the woven material. The placement of such common and/or intermediate warp zone may be shifted within the woven material, and may therefore be generated by weft yarns having various points of origin, points of wrapping, and points of return within the woven material and with respect to one or more boundaries of the woven material.

In some aspects, a common warp zone may be dynamically positioned within the woven material based on a placement and/or number of the intermediate warp yarn (or yarns) with respect to the adjacent warp yarns forming the shed of the woven material. In one example, a common warp zone may be generated from two weft yarns that originate on opposing sides of the woven material, travel through their respective portions of the material shed, and wrap the intermediate warp yarns to provide a common warp zone within the material that is wrapped by both weft yarns. In this example, the weft yarns may then return to the respective origins on the opposing sides of the material. During dynamic placement of such common warp zone, the placement of the intermediate warp yarns may dynamically shift across the material width while still returning each weft yarn to the corresponding sides of the material. Additionally, the number of intermediate warp yarns may impact the dynamic placement of the common warp zone by increasing or decreasing the number of intermediate warp yarns in the common warp zone, while still returning each weft yarn to the corresponding side of the material.

In another example, the dynamic placement of a common warp zone may be shifted with respect to adjacent warp yarns without at least one of the weft yarns of the common warp zone returning to an outer edge of the woven material. For example, a first common warp zone may include a first weft yarn that originates on a left side (i.e., left outer edge) of the material, wraps the common warp zone, and returns to the left side of the material. The first common warp zone may also be wrapped by a second weft yarn that does not originate on the right side of the material, but wraps the common warp zone and returns to its alternate origin, such as a position above or below the woven material. In this example, the second weft yarn may also be utilized to wrap a second common warp zone within the material. As such, the second weft yarn and a third weft yarn may wrap the second common warp zone, with the third weft yarn originating on the right side (i.e., right outer edge) of the woven material. Accordingly, the dynamic placement of a common warp zone within a woven material may include a warp zone created at an intermediate portion of the woven material, without carrying a weft yarn that originates on the left or right selvedge edges of the woven material. In some examples, an alternate carrier may have an origin at a location other than the left and right selvedges of the woven material, providing a dynamic zone that shifts within the material, without wrapping and/or returning to a left or right side of the material. In further aspects, utilizing weft yarns having multiple origins, a dynamic, intermediate warp zone may include a first weft yarn having a first alternate origin (other than a left or right selvedge edge) and a second weft yarn having a second alternate origin (other than a left or right selvedge edge), which both wrap the warp yarns of the common warp zone.

In addition to varying a location of a common/intermediate warp zone origin, insertion, and/or placement within the woven material, the warp yarns of the shed of woven material and the warp yarns of the intermediate warp zone may be made of one or multiple materials. For example, in one aspect, warp yarns forming a shed of woven material on the left and right sides of an intermediate warp zone (i.e., single intermediate warp yarn or multiple intermediate warp yarns) may be a first warp yarn material, while the warp yarns of the intermediate warp zone may be a different, second material. As such, the intermediate warp zone may be wrapped with the same first and second weft yarns carried throughout the shed of the woven material, while the resulting zonal material of the warp yarns in the intermediate warp zone is different from the neighboring warp yarns not being wrapped. The intermediate warp zone may therefore provide a particular zone of material within the resulting woven fabric having added characteristics associated with the dual-wrapped weft yarns from the first and second sides, as well as the varying material of the intermediate warp yarns as compared to the adjacent warp yarns of the shed.

In another aspect, the intermediate warp zone may include the same or similar material as the adjacent left and right shed of warp yarns on each side of the intermediate warp zone. As such, in some weaving systems, the intermediate warp zone maintains different zonal characteristics based on the wrapping of the intermediate warp yarn/yarns with both the first and second weft yarns. In other words, without changing any of the warp yarn materials along the length of the fabric, a zonal feature having specific structure or function (e.g., a specific shape of dual-wrapped zone), may be created utilizing the selective placement of the intermediate warp zone yarn(s) (i.e., without changing a yarn type being woven in the base material).

In one aspect, a zonal weaving device for providing a zonal woven material includes: a first carrier on a first side of the zonal weaving device, said first carrier configured to carry a first weft yarn from the first side of the zonal weaving device; a second carrier on a second side of the zonal weaving device, said second carrier configured to carry a second weft yarn from the second side of the zonal weaving device, wherein the first side of the zonal weaving device is opposite the second side of the zonal weaving device, wherein the first carrier is configured to carry the first weft yarn through a first shed of a woven material without carrying the first weft yarn to the second side of the zonal weaving device, and the second carrier is configured to carry the second weft yarn through a second shed of the woven material without carrying the second weft yarn to the first side of the zonal weaving device, said woven material comprising a plurality of warp yarns having one or more first shed warp yarns, one or more second shed warp yarns, and one or more intermediate warp yarns adjacent the one or more first shed warp yarns and the one or more second shed warp yarns, wherein the first carrier is configured to carry the first weft yarn after the first weft yarn wraps around the one or more intermediate warp yarns, and the second carrier is configured to carry the second weft yarn after the second weft yarn warps around the one or more intermediate warp yarns.

In another aspect, a zonal weaving method for generating a woven material having a common woven zone includes: receiving a first weft yarn from a first side of a weaving loom, said first weft yarn received via a first shed portion comprising a plurality of first upper warp yarns and a plurality of first lower warp yarns; wrapping the first weft yarn around one or more zonal warp yarns in a first direction; exchanging the plurality of first upper warp yarns and the plurality of first lower warp yarns; returning the first weft yarn to the first side of the weaving loom; receiving a second weft yarn from a second side of a weaving loom, said second weft yarn received via a second shed portion comprising a plurality of second upper warp yarns and a plurality of second lower warp yarns; wrapping the second weft yarn around the one or more zonal warp yarns in a second direction; exchanging the plurality of second upper warp yarns and the plurality of second lower warp yarns; and returning the second weft yarn to the second side of the weaving loom.

In further aspects, a zonal woven material includes: a first woven portion comprising a plurality of first warp yarns and a first weft yarn; a second woven portion comprising a plurality of second warp yarns and a second weft yarn; a common woven zone adjacent the first woven portion and the second woven portion, wherein the common woven zone comprises one or more zonal warp yarns, the first weft yarn, and the second weft yarn.

With reference now to the figures, devices and methods for creating a zonal woven material with a multi-carrier, zonal weaving system are provided. Configurations depicted herein include a double-carrier system for illustration purposes; however, it is contemplated the any number of carriers may be implemented in aspects hereof (e.g., two, three, four, five carriers). Therefore, while discussion herein provides for a double-carrier, it is understood that any number of carriers are contemplated, with any number of corresponding weft yarns. Various aspects are described with respect to the figures in which like elements are depicted with like reference numerals.

Turning first to FIG. 1, a perspective view of an exemplary prior art weaving system 10 is provided, having a first plurality of warp yarns 12 in an upper position, a second plurality of warp yarns 14 in a lower position, and a weft yarn 18 carried through the weaving system 10 by the carrier 20. In this exemplary system 10, only a single carrier 20 is utilized for weaving the single weft yarn 18 along the x-axis, through the shed 16 between the upper and lower warp yarns 12 and 14, such that the fabric 22 is woven and advances along the y-axis. In one aspect, the system 10 includes a left side 24, a right side 26, multiple warp yarns 28 of the first plurality of warp yarns 12, and multiple warp yarns 30 of the second plurality of warp yarns 14 that are woven together in response to the passage of the weft yarn 18 at right angles to the warp yarns through the shed 16, becoming a woven fabric 22 in response to beating of the weft yarns in the backward direction 32, against adjacent rows of weaving. The woven fabric 22 may include a top side 34, a bottom side 36, and well turns 38 that provide a continual passage of the single weft yarn 18 throughout the fabric 22.

Figure 2:
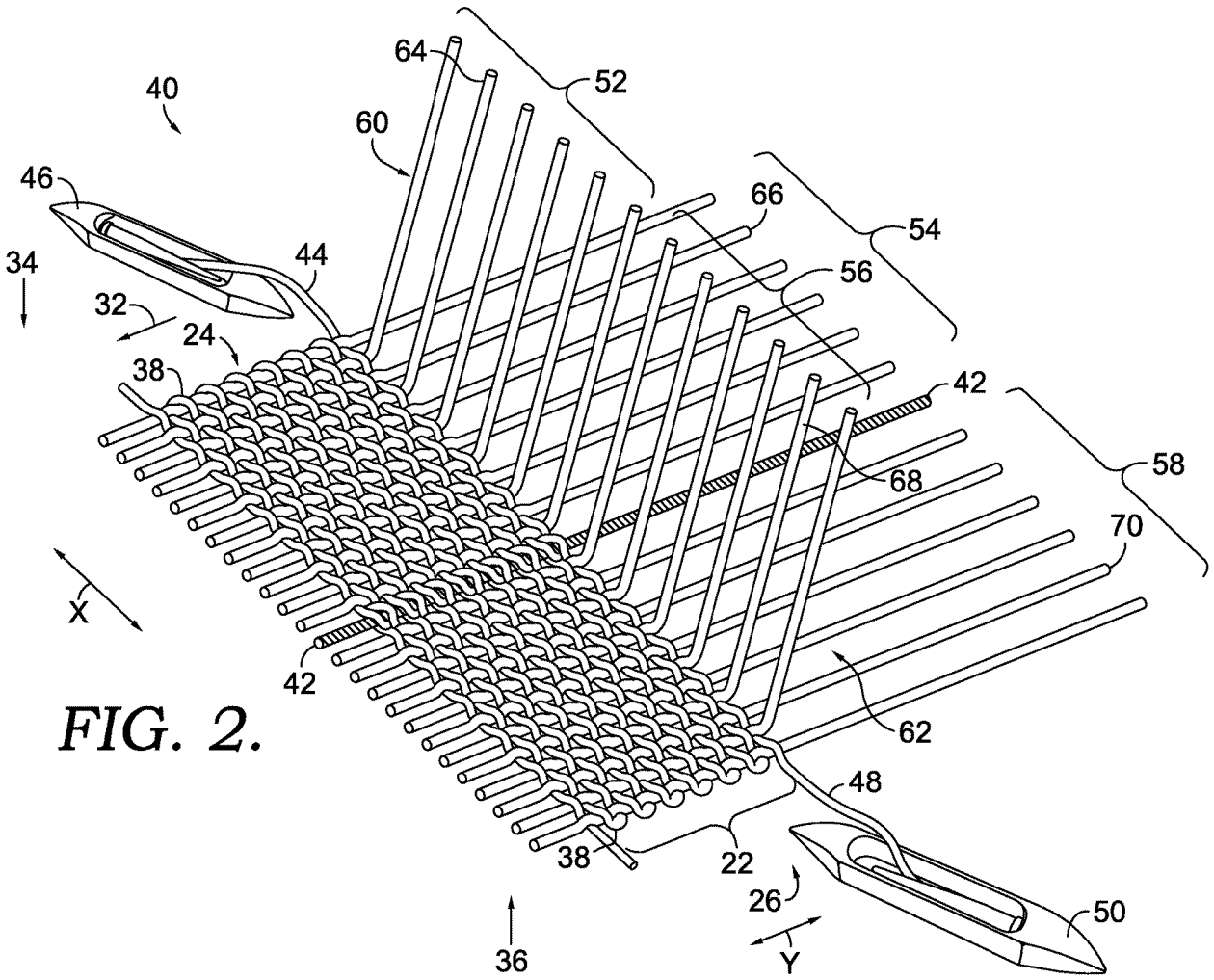
FIG. 2 is a perspective view of an exemplary double-carrier, zonal weaving system, in accordance with aspects.

Referring next to aspects hereof, FIG. 2 is a perspective view of an exemplary double-carrier, zonal weaving system 40 having an intermediate warp yarn 42 that is wrapped by both the left weft yarn 44 via the left carrier 46 and the right weft yarn 48 via the right carrier 50. The intermediate warp yarn 42 may refer to a single warp yarn or multiple warp yarns positioned between the left and right sheds of the woven material, such as a central warp yarn in the middle of the woven material. In another example, the intermediate warp yarn 42 may refer to a single or multiple warp yarns at a different point between the left and right sides of the woven material, such as an off-centered intermediate warp zone. Accordingly, while aspects are described with respect to an intermediate warp zone having intermediate warp yarns between multiple left shed warp yarns and multiple right shed warp yarns, the position of the intermediate warp zone and corresponding intermediate warp yarns with respect to adjacent left and right shed warp yarns may change in a direction of the x-axis.

In one aspect, the left carrier 46 and right carrier 50 may refer to any carrying mechanism for transporting a weft yarn through at least a portion of a shed of the woven material, such as a rapier, a shuttle, an airjet, a water jet, a robotic feeder, and the like. In one aspect, the left and right carriers 46 and 50 may be carried by hand through the left shed 60 and right shed 62 using one or more carrier methods for delivery. In further aspects, the positioning of each carrier and travel of the corresponding weft yarns through the left shed 60 and right shed 62 may be driven by mechanical means to provide an automated woven material using a double-carrier system for zonal weaving. As such, a first carrier method may be used to transport the left weft yarn 44 and the right weft yarn 48 through the shed of the woven material, while additional or alternative carrier methods may be used to wrap the left and right weft yarns 44 and 48 around the intermediate warp yarn 42, according to various aspects. Additionally, while depicted in this example as including "left" and "right" weft yarns of the woven material, in further aspects, the weft yarns may be referred to as first and second weft yarns, primary and secondary yarns, or any other designation that provides at least one weft yarn from one origin and another weft yarn from another origin.

As further shown in FIG. 2, the common warp zone A of the woven fabric 22 is wrapped by both the left weft 44 and the right weft 48 based on separation of the first plurality of warp yarns 52, the second plurality of warp yarns 54, the third plurality of warp yarns 56, and the fourth plurality of warp yarns 58. The first plurality of warp yarns 52 includes a plurality of warp yarns 64 that alternate with the plurality of warp yarns 66 of the second plurality of warp yarns 54. Similarly, the third plurality of warp yarns 56 includes a plurality of warp yarns 68 that alternate with the plurality of warp yarns 70 of the fourth plurality of warp yarns 58. As will be understood, alternating single warp yarns demonstrated in FIG. 2 may be manipulated individually by one or more mechanical features of a weaving loom, such as a Jacquard loom system. In further aspects, multiple sets of alternating yarns may be individually manipulated in multiple different woven patterns according to one or more weaving loom techniques to provide varying woven structures surrounding the common woven zone A. As such, aspects hereof may utilize one or more techniques for automated and/or mechanical manipulation of the warp and weft yarns that also utilize the double-carrier features of various aspects.

Figure 3:
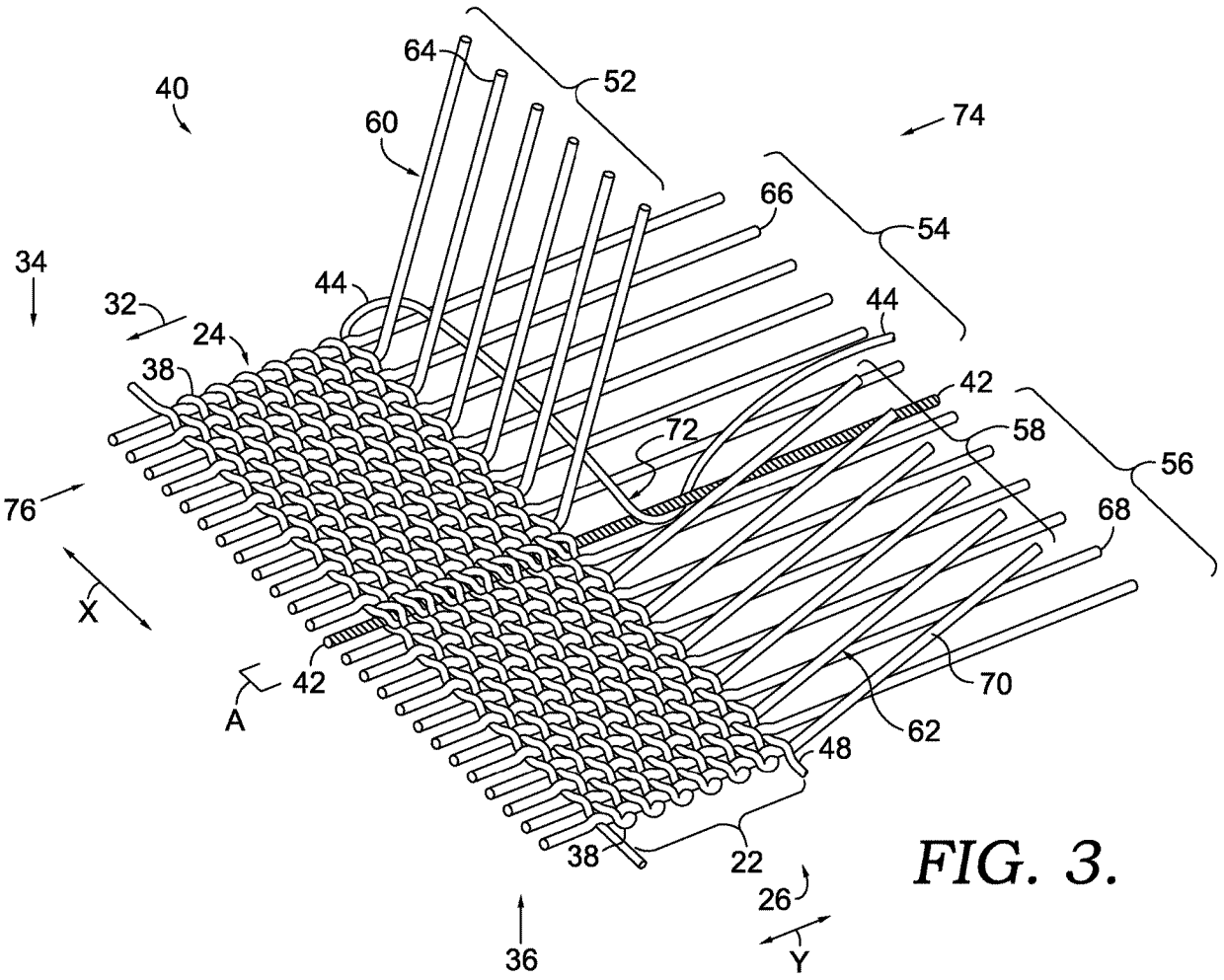
FIG. 3 is a perspective view of an exemplary double-carrier, zonal weaving system, in accordance with aspects.

During operation of the double-carrier weaving system, as shown in FIG. 3, the left weft yarn 44 enters the left shed 60 from the left side 24, is carried along the x-axis, and forms a wrap 72 around the intermediate warp yarn 42. The addition of weft yarns to the woven fabric 22 builds in the direction of the working edge 74, along the y-axis and away from the starting edge 76. In doing so, the weft yarns may be forced in a backward direction 32, as the double-carrier system is operated and the woven fabric 22 is oriented in a single plane. As further shown in FIG. 3, and in subsequent figures, the first, second, third, and fourth plurality of warp yarns 52, 54, 56, and 58 may be alternated in upward and downward positions such that the left shed 60 and right shed 62 exchanges warp yarns throughout weaving. In some aspects, the tension along the y-axis may be adjusted while the left and right sheds 60 and 62 are open, thereby preventing shifting, bunching, and or tugging of the overall material during weaving.

Figure 4:
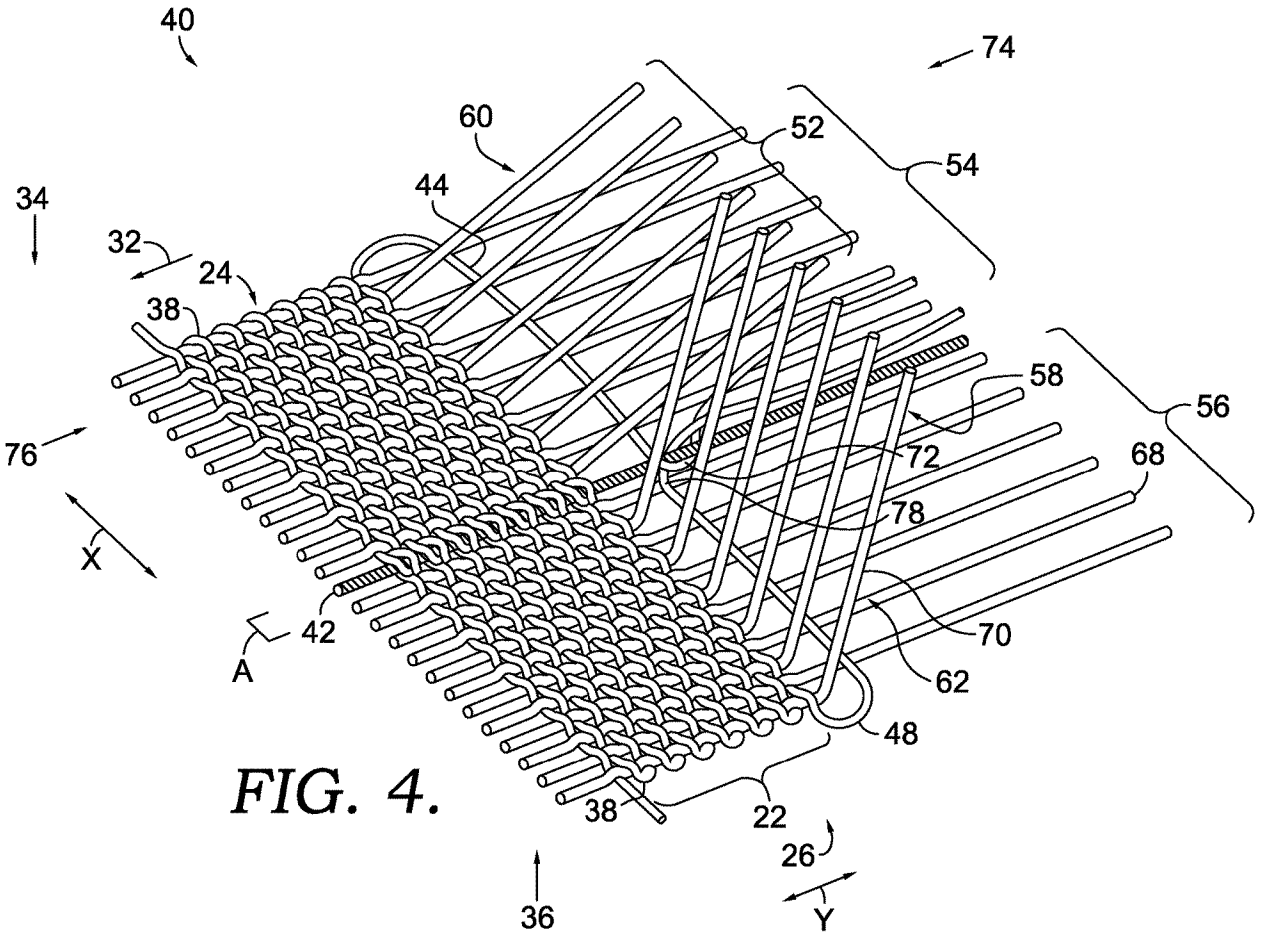
FIG. 4 is a perspective view of an exemplary double-carrier, zonal weaving system, in accordance with aspects.

In the perspective view of the double-carrier, zonal weaving system 40 in FIG. 4, the right weft 48 enters the right shed 62 from the right side 26, is carried in the direction of the x-axis, and forms a wrap 78 around the intermediate warp yarn 42. In one aspect, the wrap 78 interlocks with the wrap 72 such that the opposing weft yarns wrap around each other, in addition to wrapping the intermediate warp yarn 42. In further aspects, based on a direction of wrapping of the left weft yarn 44 and the right weft yarn 48 around the intermediate warp yarn 42, the interlocking features of the left and right weft yarns 44 and 48 may change. For example, rotation of the left weft yarn 44 over the intermediate warp yarn 42 (e.g., from a top side 34) may provide a first loop of left weft yarn 44 at the wrap 72, which may then be interlocked with the right weft yarn 48 wrapped under the intermediate warp yarn 42 (e.g., from a bottom side 36) to provide a second loop of right weft yarn 48 at the wrap 78. In some aspects, the direction of wrapping may be reversed with respect to the left and right weft yarns 44 and 48. For example, the right weft yarn 48 may wrap over the intermediate warp yarn 42 (from the top side 34), while the left weft yarn 44 may wrap under the intermediate warp yarn 42 (from the bottom side 36).

In further examples, based on an orientation of wrapping of the weft yarns and/or direction of travel of the respective carriers driving each weft yarn, direction of wrapping around the intermediate warp yarn 42 may be in a similar direction and from a similar side of the material. For example, rotation of the left weft yarn 44 over the intermediate warp yarn 42 (from top side 34) may provide a first loop of left weft yarn 44 at the wrap 72, which may then be interlocked with the right weft yarn 48 also wrapped over the intermediate warp yarn 42 (also from top side 34) to provide a second loop of right weft yarn 48 at the wrap 78. In another example, rotation of the left weft yarn 44 under the intermediate warp yarn 42 (from bottom side 36) may provide a first loop of left weft yarn 44 at the wrap 72, which may then be interlocked with the right weft yarn 48 also wrapped under the intermediate warp yarn 42 (from bottom side 36) to provide a second loop of right weft yarn 48 at the wrap 78. Stated differently, it is contemplated that the right weft yarn 48 and the left weft yarn 44 may both wrap in a clockwise orientation, a counterclockwise orientation, or a first of the weft yarns in a clockwise orientation and the second weft yarn in a counterclockwise orientation about the intermediate warp yarn 42, in exemplary aspects. This rotational orientation of wrapping may be affected by a top side or bottom side entry into the wrapping action by a weft. It is contemplated that the wrapping weft yarn(s) may interlock or not interlock in each of the contemplated wrapping configurations provided herein.

In further aspects, the loop of left weft yarn 44 and the loop of right weft yarn 48 may be provided by simultaneous travel of both the left and right carriers transporting the left and right weft yarns 44 and 48. The left weft yarn 44 loop and the right weft yarn 48 loop may be provided in any order required during wrapping of the intermediate warp yarn 42, such as creating a loop of right weft yarn 48 before or after creating the loop of left weft yarn 44.

Similarly, in further aspects, the number and/or type of interlocking features between opposing weft yarns may vary, such as an additional number of times the weft yarns are hooked together or a different type of interlocking technique to both join the meeting weft yarns at the intermediate warp yarn 42 and wrap the intermediate warp yarn 42 to produce the common warp zone A. In one aspect, the order of wrapping around the intermediate warp zone may change based on a row of weaving of the woven material, an overall woven design and/or pattern of the finished material, and/or an adjusted tensioning of the left and right weft yarns based on a change in the intermediate warp zone width and corresponding change in one or both of the adjacent warp sheds.

Figure 5:
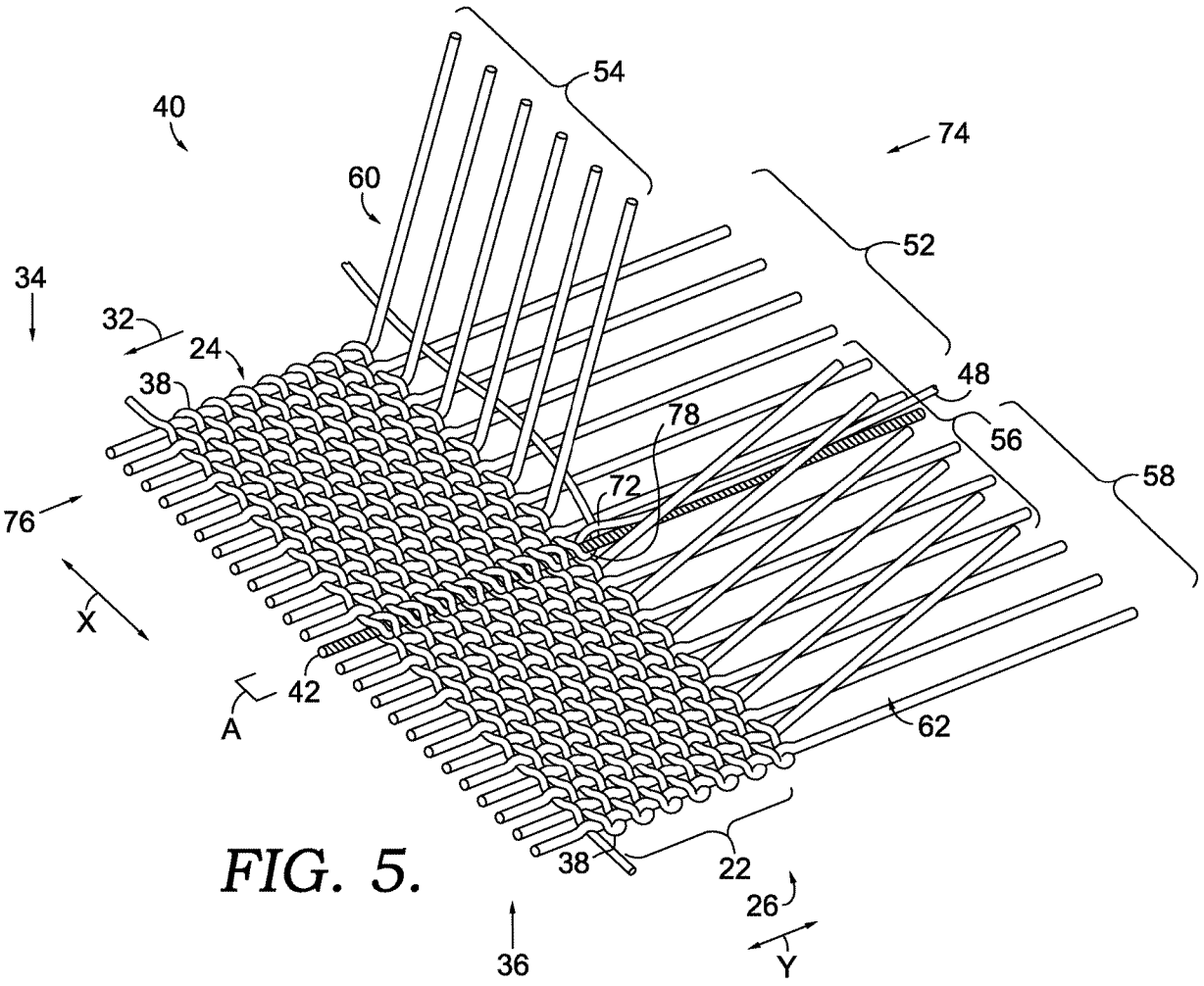
FIG. 5 is a perspective view of an exemplary double-carrier, zonal weaving system, in accordance with aspects.
Figure 6:
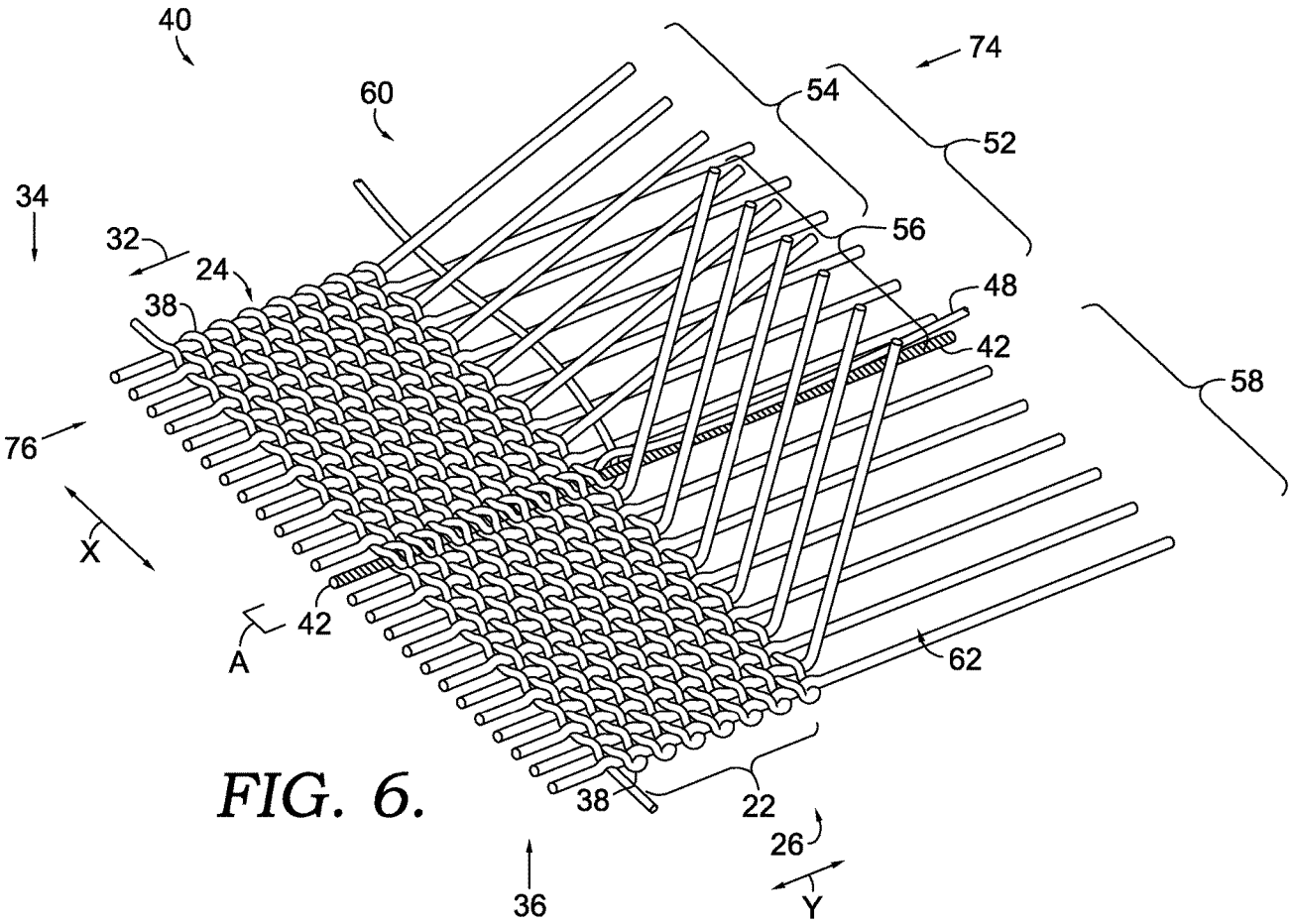
FIG. 6 is a perspective view of an exemplary double-carrier, zonal weaving system, in accordance with aspects.
Figure 7:
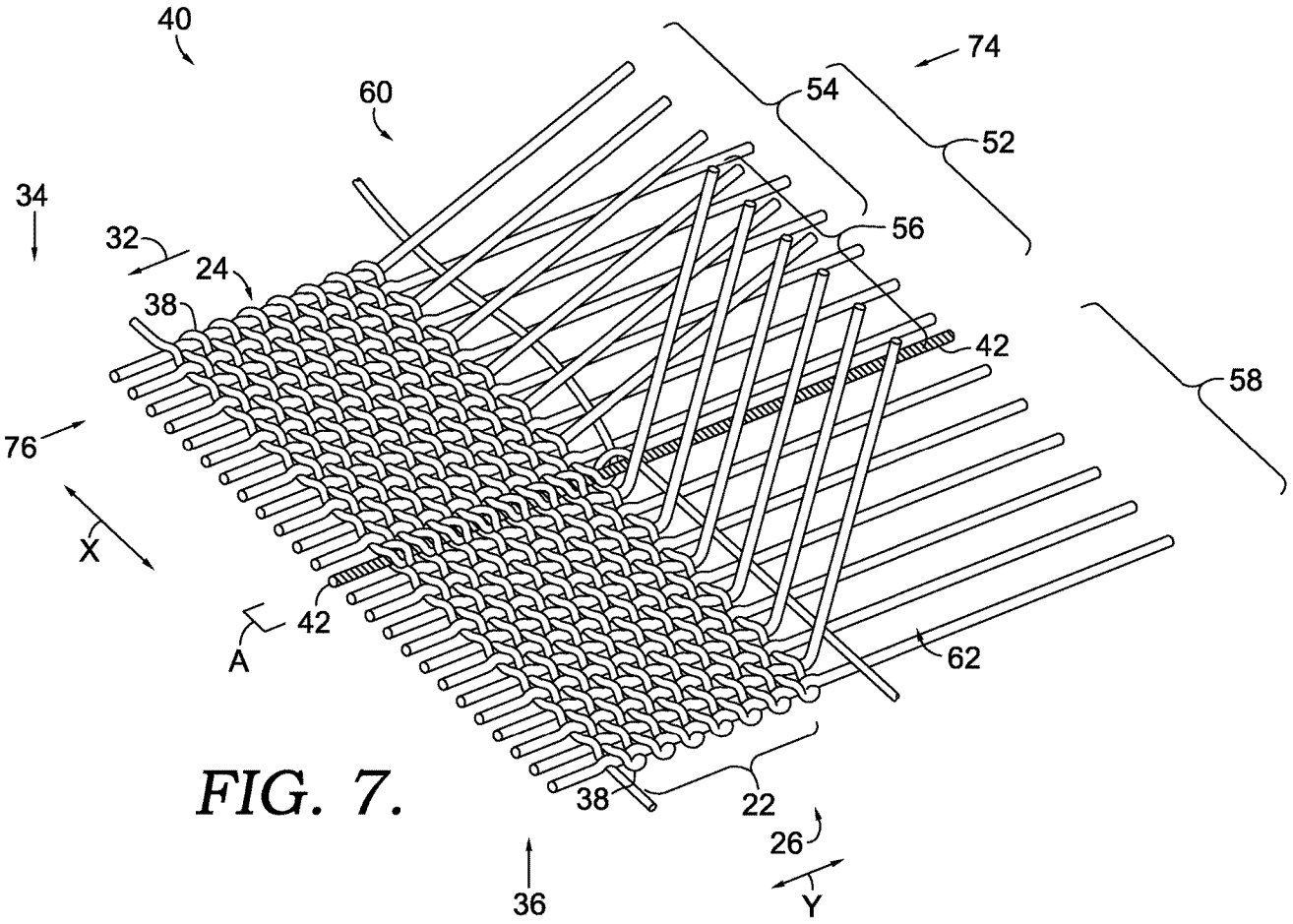
FIG. 7 is a perspective view of an exemplary double-carrier, zonal weaving system, in accordance with aspects.
Figure 8:
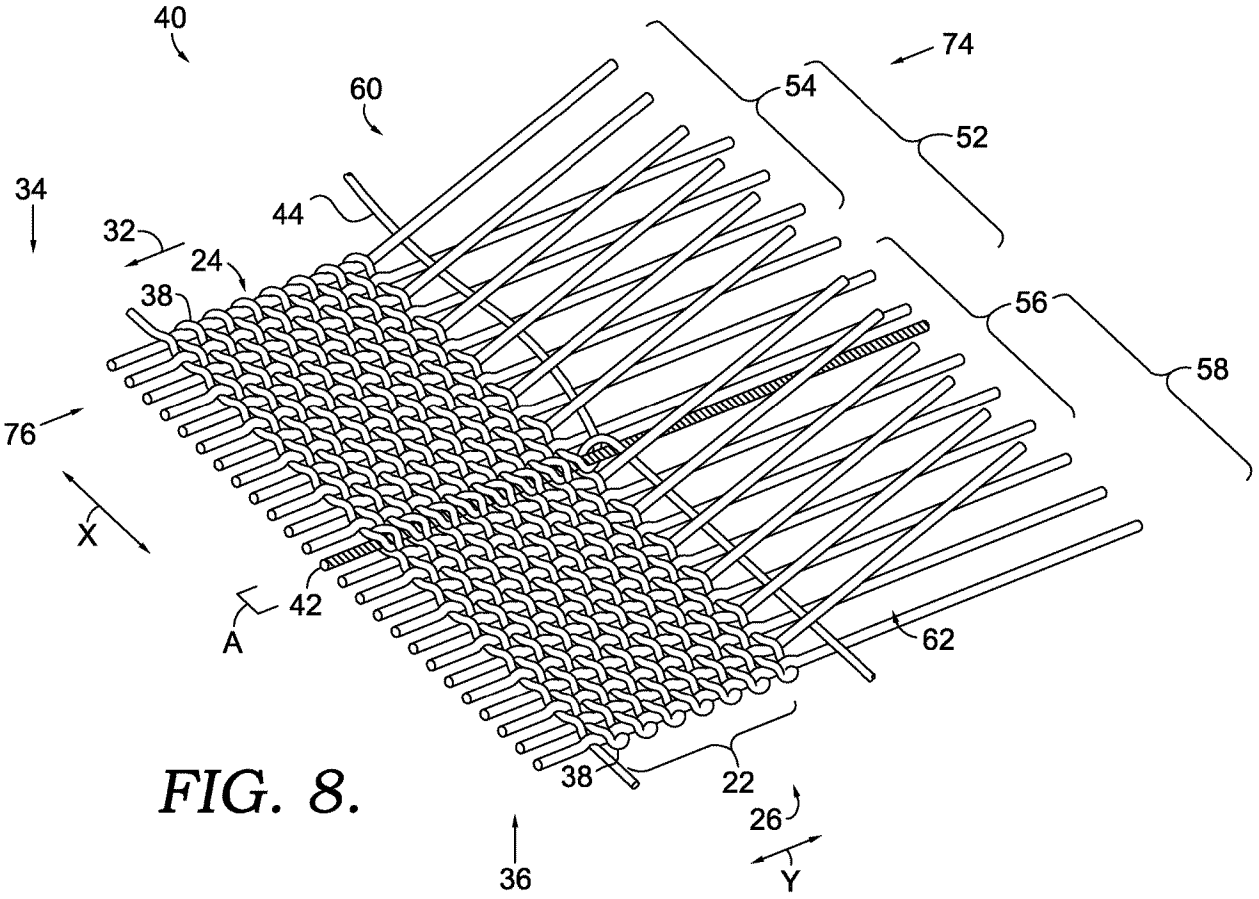
FIG. 8 is a perspective view of an exemplary double-carrier, zonal weaving system, in accordance with aspects.

In FIG. 5, the double-carrier, zonal weaving system 40 depicts the left weft yarn 44 returning to the left side 24 of the fabric 22 through the opened left shed 60, after the exchange of the first plurality of warp yarns 52 and the second plurality of warp yarns 54 (i.e., from raised and lowered positions with respect to the plane of the fabric 22 in the direction of the y-axis and the position of the left weft yarn 44 in the direction of the x-axis). Similarly, in FIG. 6, the right shed 62 is opened for return of the right weft yarn 48, as the fourth plurality of warp yarns 58 is now raised to an upper position while the third plurality of warp yarns 56 is lowered. In FIG. 7, the right weft yarn 48 is returned to the right side 26 of the fabric 22 along the x-axis. In some aspects, as shown in FIG. 8, the left weft 44 and right weft 48 yarns enter opposing sheds 60 and 62, wrap the intermediate warp yarn 42 to provide a common warp zone A on the fabric 22, and return to the left and right sides of the fabric 22 upon exchange of the upper and lower sets of warp yarns.

Although FIGS. 2-8 depict separate instances of left and right weft yarns entering a shed, wrapping an intermediate warp zone, and returning to an original side of the woven material, the left and right weft yarns may be configured to simultaneously enter the left and right sheds for wrapping the intermediate warp yarns. Similarly, in further aspects, the left and right weft yarns may simultaneously return to the left and right sides of the woven material by returning to an original starting side of the material. It will be understood that wrapping of the intermediate warp yarns may refer to wrapping of the left weft yarn at the same time as the right weft yarn, wrapping of the left weft yarn before wrapping of the right weft yarn, or wrapping of the left weft yarn after wrapping of the right weft yarn. As such, the carriers used to deliver the left and right weft yarns into the left and right sheds may travel at the same time or at different times depending on the direction of travel and the overlapping and/or interlocking features of the intermediate warp zone.

Figure 9:
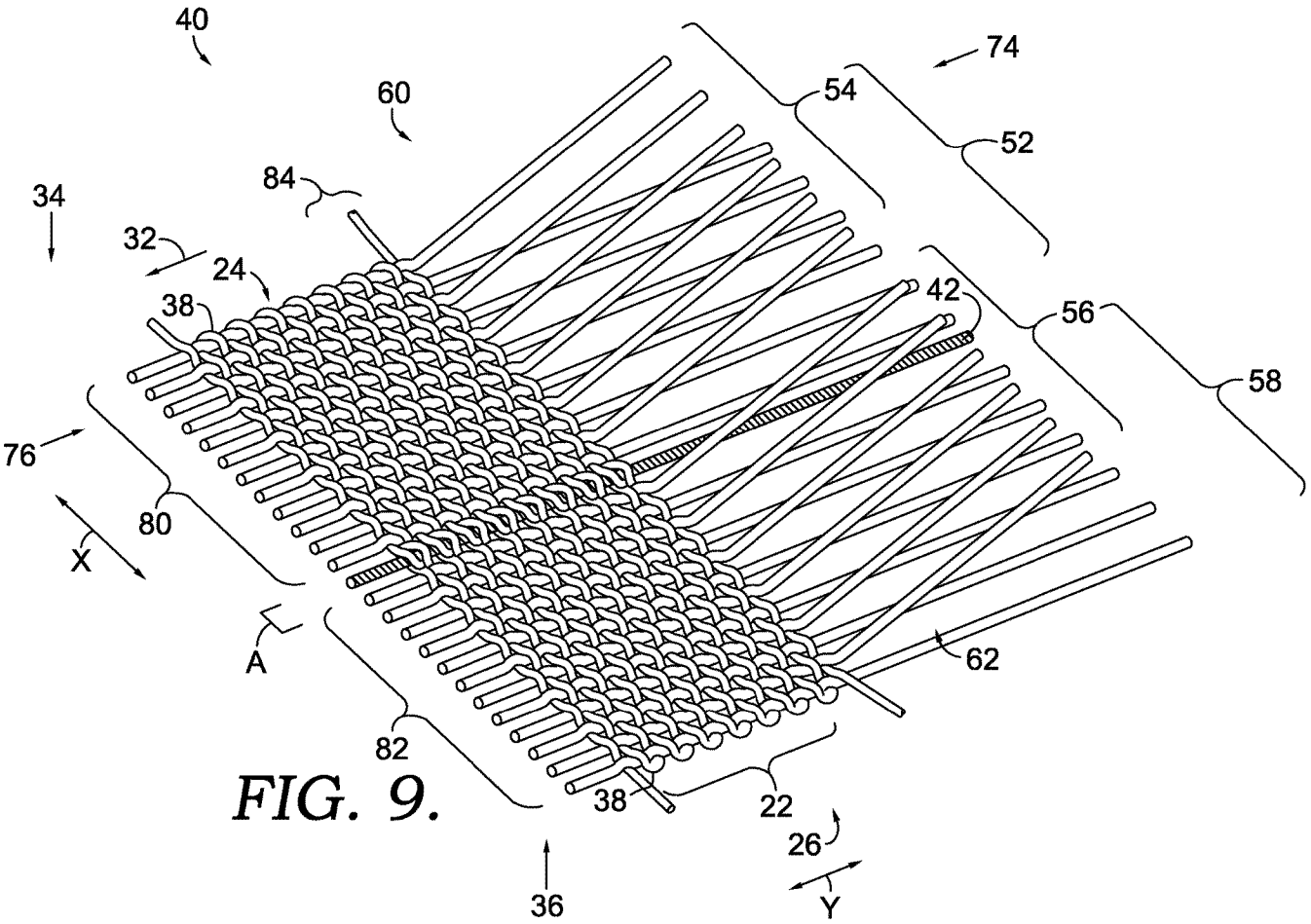
FIG. 9 is a perspective view of an exemplary double-carrier, zonal weaving system, in accordance with aspects.

In the exemplary aspect of FIG. 9, the fabric 22 includes a first portion 80 adjacent the intermediate warp yarn 42, and a second portion 82 adjacent the intermediate warp yarn 42. As such, the first portion 80 and second portion 82 are adjacent the common warp zone A, to provide an overall width of the fabric 22 along the x-axis that is consistent along the length of the fabric increasing along the y-axis. In one aspect, each passage of the weft yarn through a shed, wrapped around the intermediate warp yarn 42, and returned through the exchanged shed provides an additional two rows 84 of fabric 22 along the y-axis.

Figure 10:
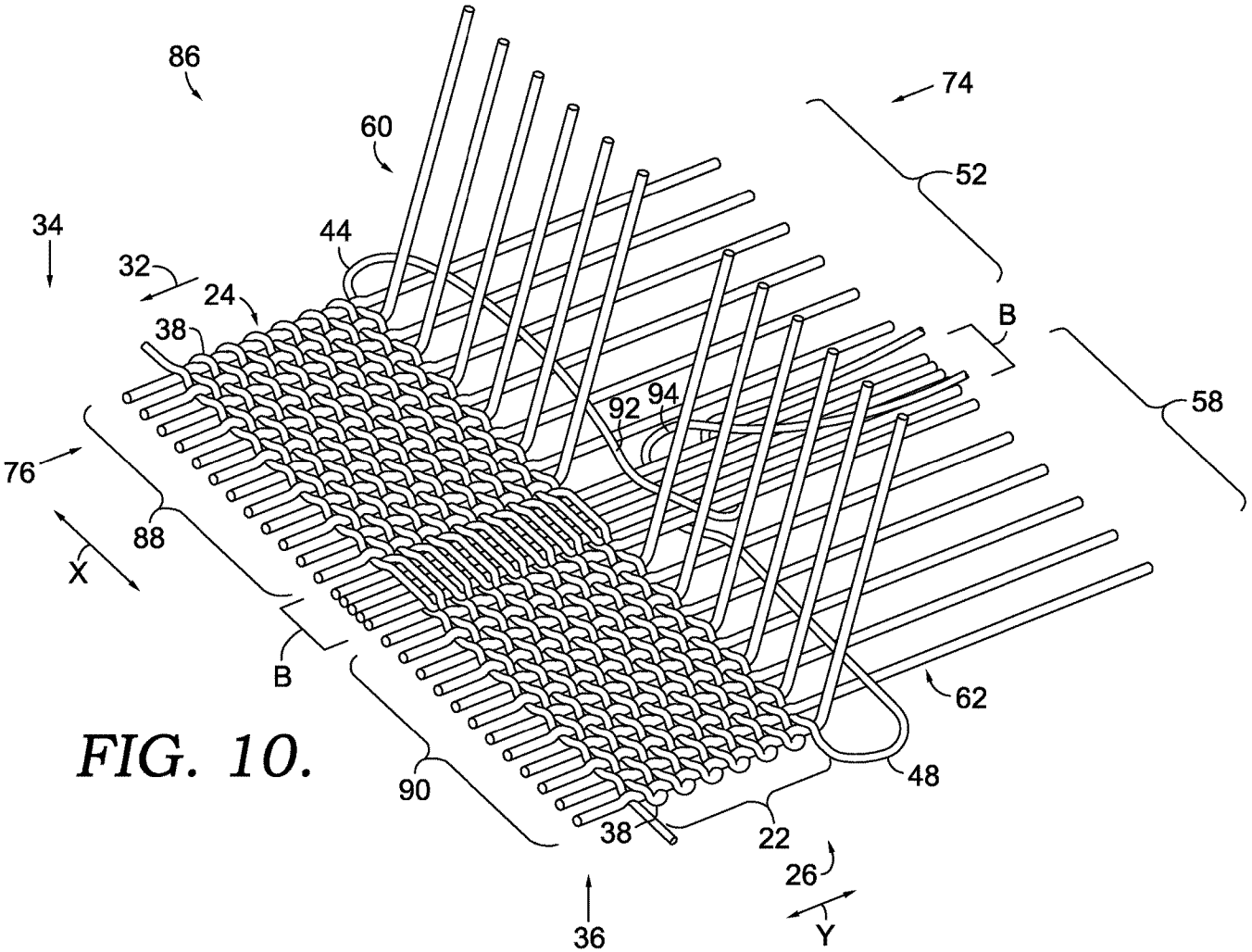
FIG. 10 is a perspective view of an exemplary double-carrier, zonal weaving system, in accordance with aspects.

Turning next to FIG. 10, an increased proportion of common zone within fabric produced by the double-carrier system 86 is provided. In this example, the fabric 22 includes a first zone 88 adjacent a common warp zone B, and a second zone 90 adjacent the common warp zone B. In the example of FIG. 10, the common warp zone B includes multiple warp yarns that are collectively wrapped by the left and right weft yarns 44 and 48. In this example, the left weft 44 wraps the common warp zone B at the wrap 92, and the right weft yarn 48 wraps the common warp zone B at the wrap 94. Various aspects may include multiple different numbers of warp yarns within the warp zone, such as a single warp yarn in the warp zone A or multiple warp yarns in the warp zone B of various fabrics 22. In another aspect, the double-carrier system 86 may include multiple warp yarns within a common warp zone B that are wrapped by opposing left and right weft yarns 44 and 48.

Figure 11A:
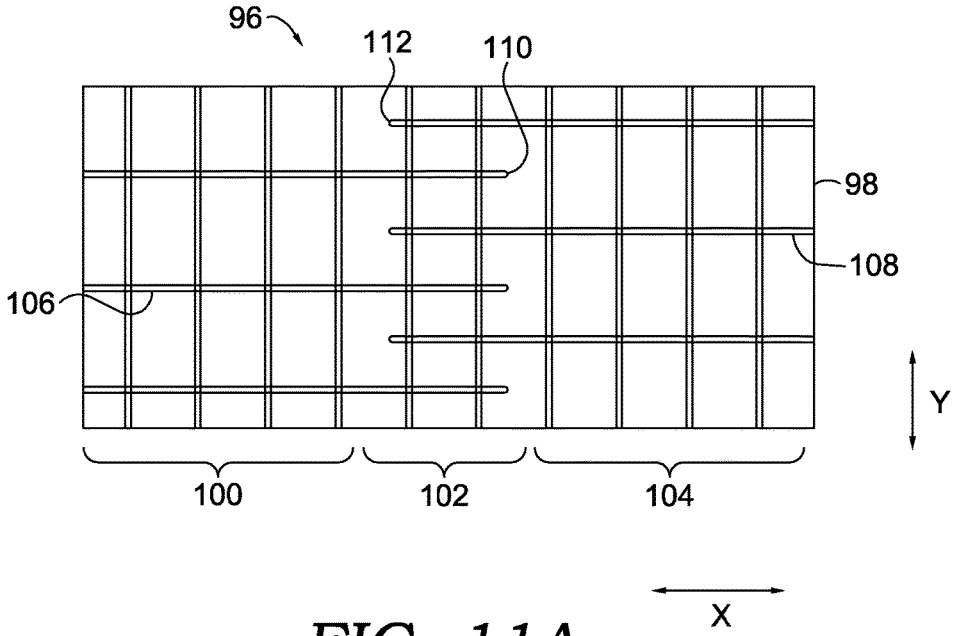
FIG. 11A is a top view of exemplary zonal weaving system components, in accordance with aspects.
Figure 11B:
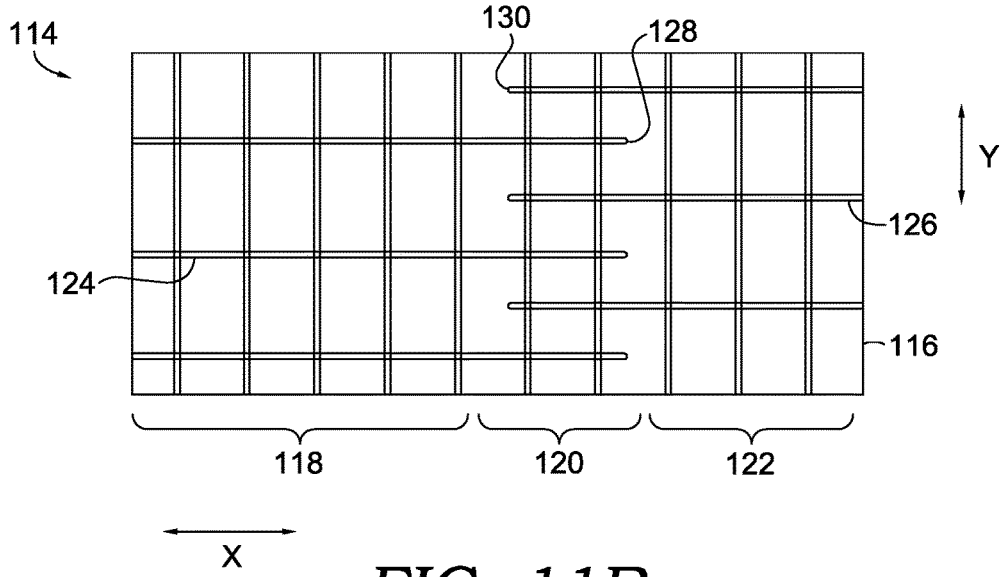
FIG. 11B is a top view of exemplary zonal weaving system components, in accordance with aspects.

Turning next to FIG. 11A, a top view of exemplary zonal weaving system 96 includes a fabric 98 having a first portion 100 of warp yarns, an intermediate warp zone 102, a second portion 104 of warp yarns, a left weft yarn 106, a right weft yarn 108, a left wrap 110, and a right wrap 112. In the example of FIG. 11A, the intermediate warp zone 102 includes two warp yarns that are wrapped by the left and right weft yarns 106 and 108. In another aspect, FIG. 11B depicts a zonal weaving system 114 having a fabric 116 that includes a first portion 118 of warp yarns, an intermediate warp zone 120, a second portion 122 of warp yarns, a left weft 124, a right weft 126, a weft wrap 128, and a right wrap 130. In some aspects, the width of the intermediate warp yarn may change throughout a fabric, while the width of the corresponding first and second portions are adjusted within the woven fabric. For example, the placement of the intermediate warp zone 102 of fabric 98 may shift to the position of the intermediate warp zone 120 in the fabric 116. As such, a dynamic change of the width of the first and second portions of the woven fabric may correspond to a change in size and/or position of the common warp zone along a fabric body. In further aspects, a dynamic tension adjustment for each of the left and right weft yarns may provide a double-carrier system configured to manipulate a position of the intermediate/common warp zone within the woven fabric.

According to some aspects, the widths of various portions of the woven material may be maintained during weaving. Alternatively, varying widths of various portions of the woven material may change dynamically during weaving such that different portions of the woven material include different widths of the intermediate woven zone. For example, in FIG. 11A, a first length of the woven material may include the first portion 100 having a first width, the second portion 104 having a second width, and the intermediate warp zone 102 having a third width. Further, as shown in FIG. 11B, a second length of the woven material may include changed widths of the intermediate woven zone and at least one of the adjacent portions of the material as compared to the example of FIG. 11A. For example, the first portion 100 may be greater than or equal to the first portion 118, the second portion 104 may be less than or equal to the second portion 122, and the intermediate warp zone 102 may be equal to the intermediate warp zone 120. In another example, the first portion 100 may be less than or equal to the first portion 118, the second portion 104 may be greater than or equal to the second portion 122, and the intermediate warp zone 102 may be different than the intermediate warp zone 120. In some aspects, in a direction of weaving of the material, the width of the intermediate warp zone may change, while adjacent first and second portions adjust to satisfy a threshold width of the woven material. During such changes, a portion of the material adjacent to an intermediate warp zone may increase or decrease based on a changing width of the width of the intermediate warp zone yarns. In that example, the narrowing of the width of the intermediate warp zone may include the return of one or more periphery yarns to the adjacent warp shed. For example, a left shed may gain additional warp yarns from a left side of a narrowing intermediate warp zone. In another example, a right shed may gain additional warp yarns from a right side of a narrowing intermediate warp zone. In further aspects, the left shed of warp yarns may decrease in response to additional warp yarns being added to a left side of the intermediate warp zone. In further aspects, the right shed of warp yarns may decrease in response to additional warp yarns being added to the right side of the intermediate warp zone.

Figure 12:
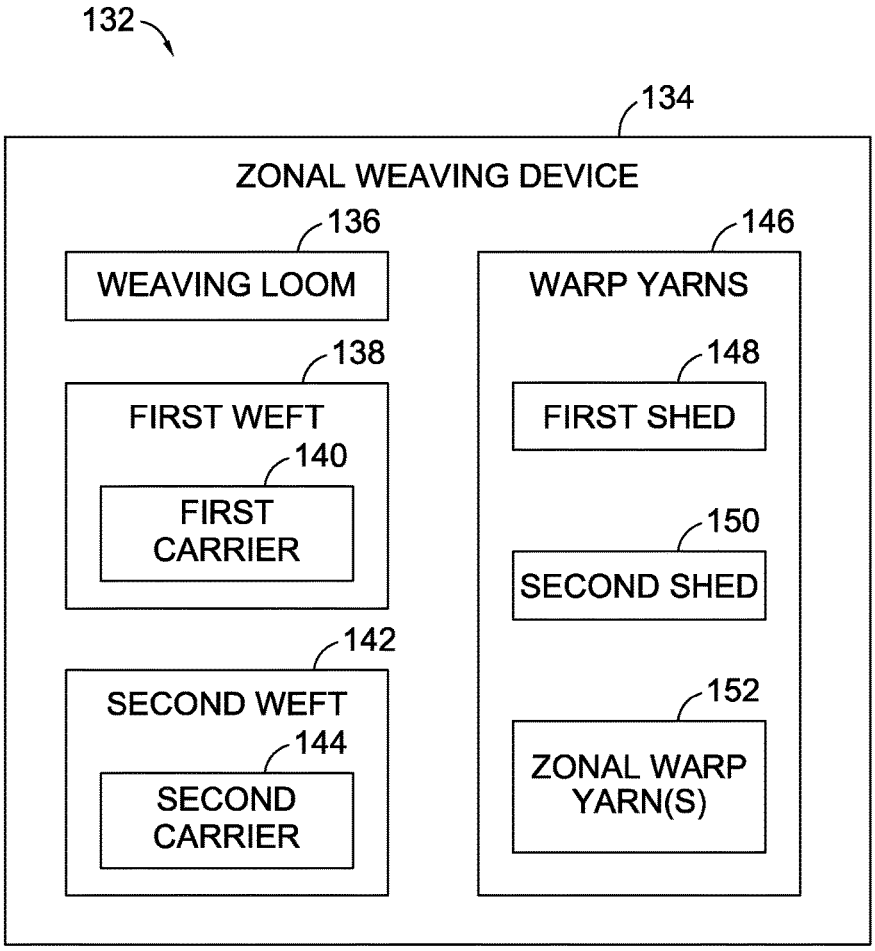
FIG. 12 is a system diagram of a zonal weaving device, in accordance with aspects.

With reference to FIG. 12, an exemplary double-carrier system 132 may include a zonal weaving device 134 having a weaving loom 136 configured to weave a fabric using a left weft 138 carried by a left carrier 140, a right weft 142 carried by a right carrier 144, and a plurality of warp yarns 146 including the left shed 148, right shed 150, and zonal warp yarn(s) 152. In some aspects, the number and/or position of warp yarns 146 may remain consistent within a woven fabric, including a dynamic number of left shed 148 warp yarns, right shed 150 warp yarns, and zonal warp yarns 152. For example, a shifting number and/or position of the zonal warp yarns 152 may correspond to a shift in number and/or position of adjacent warp yarns of the left and right sheds 148 and 150. In another aspect, the tension applied to each of the left weft 138 and right weft 142 by the left and right carriers 140 and 144 may dynamically adjust for the changes in number and/or position of warp yarns across the fabric.

Figure 13:
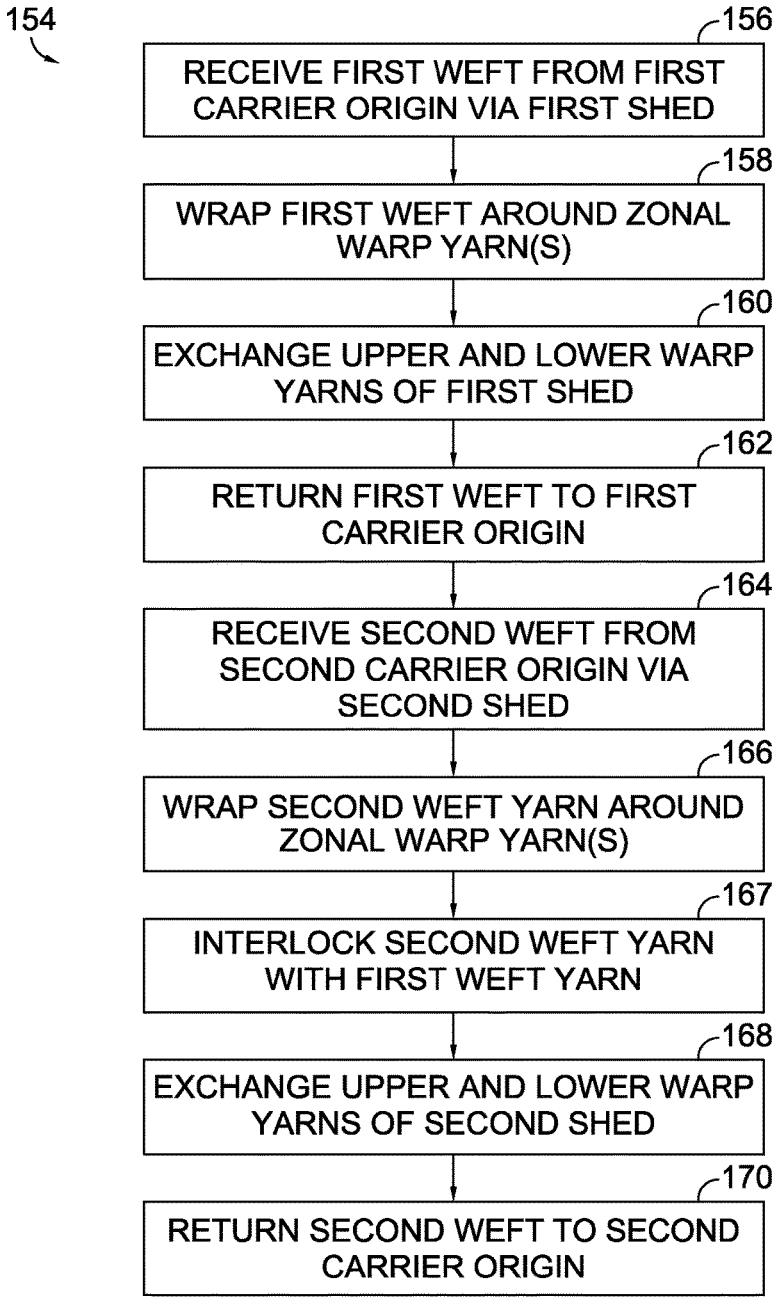
FIG. 13 is a flow diagram of a zonal weaving method, in accordance with aspects.

An exemplary method 154 of using the double-carrier system is provided in FIG. 13. At block 156, a first weft is received from a first side of the weaving loom via a first shed. At block 158, the first weft is wrapped around the zonal warp yarns. Further, at block 160, the upper and lower warp yarns are exchanged with respect to the first shed. Once the first weft is returned to the first side at block 162, the second weft is received from the second side of the weaving loom via the second shed at block 164. At block 166, the second weft is wrapped around the zonal warp yarns. In one aspect, such wrapping of the second weft includes interlocking the second weft with the first weft at block 167. At block 168, the upper and lower warp yarns of the second shed are exchanged, and the second weft is returned to the second side at block 170.

Figure 14:
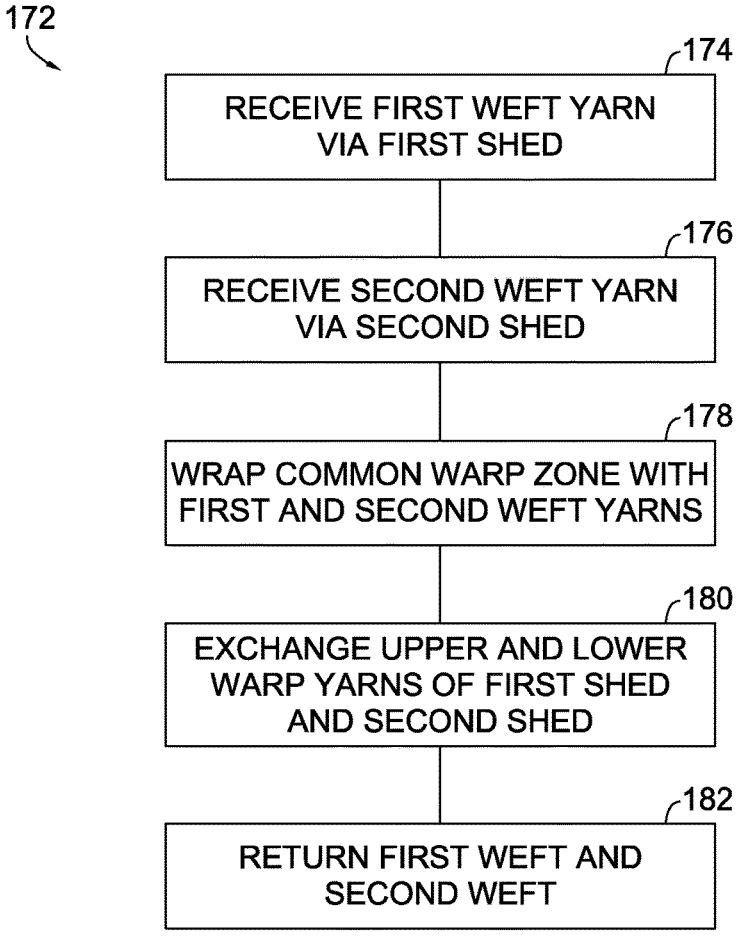
FIG. 14 is a flow diagram of a zonal weaving method, in accordance with aspects.

Turning finally to FIG. 14, an exemplary method 172 for zonal weaving with a double-carrier system is provided. At block 174, the left weft yarn is received via the left shed. At block 176, a right weft yarn is received via a right shed. In further aspects, a right weft may be received prior to the left weft, as blocks 174 and 176 may be alternated, and an order of wrapping and weaving may be switched between right and left sides. At block 178, the common warp zone is wrapped by both the left and right weft yarns. In some aspects, the left and right weft yarns may be interlocked during wrapping of the common warp zone. Further, at block 180, the upper and lower warp yarns of the left shed and right shed are exchanged, during weaving of the fabric. As such, at block 182, the left weft is returned to the left side and the right weft is returned to the right size.

In further aspects, the first and second weft yarns may be used to wrap one or multiple intermediate warp yarns to provide a common wrapped zone of a woven fabric. In one aspect, the first and second weft yarns face in opposing directions across the x-axis of a woven fabric and the carriers of each weft yarn may dynamically adjust a tension of each weft yarn to provide a common wrapped zone that maintains its position with respect to the fabric width during weaving along the y-axis of the fabric. Accordingly, a dynamic tension adjustment to each weft yarn applied by the double-carrier system may provide an adjustable fabric tension that maintains the overall structure of the woven material while increasing or decreasing the width of weft yarn portions concentrated within the common wrapped zone.

Figure 15:
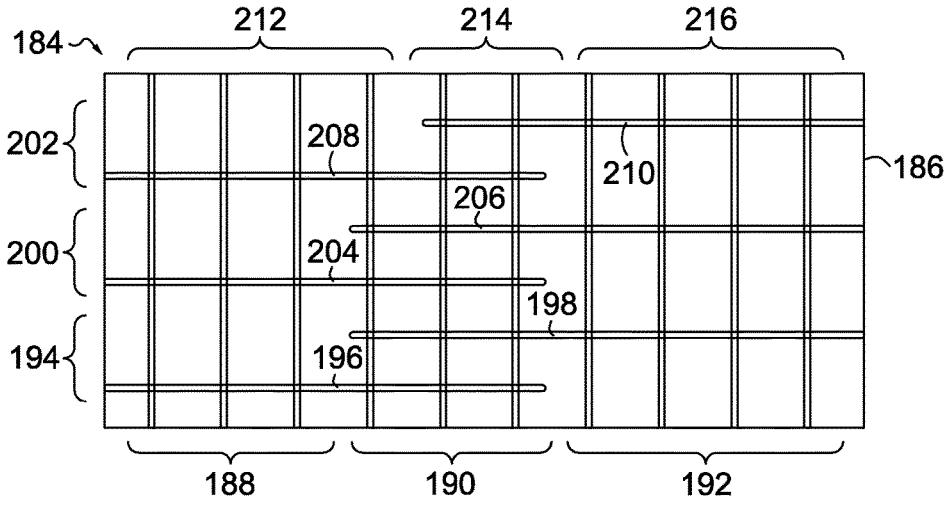
FIG. 15 is a top view of exemplary zonal weaving system components, in accordance with aspects.

Turning next to FIG. 15, a top view of exemplary zonal weaving system 184 includes a fabric 186 having a first portion 188 of warp yarns, a primary intermediate warp zone 190, a second portion 192 of warp yarns, and a first woven segment 194 including a first weft yarn 196 and a second weft yarn 198 that combine to wrap the common yarns of primary intermediate warp zone 190. While continuing to generate the zonal woven features of fabric 186, in a second woven segment 200 adjacent the first woven segment 194, the first weft yarn 204 and second weft yarn 206 are woven to wrap the same primary intermediate warp zone 190 that was wrapped in first woven segment 194, such as the three warp yarns of the primary intermediate warp zone 190. During weaving of at least a portion of the second woven segment 200, the first weft yarn 204 may be carried through the first portion 188 via the first carrier (e.g., the same first carrier that transported the first weft yarn 196). Additionally, the first carrier may be configured to wrap the first weft yarn 204 around the primary intermediate warp zone 190 before returning to a starting position, such as the selvedge edge or an alternate origin. In some aspects, the second carrier may be configured to wrap the second weft yarn 206 around the primary intermediate warp zone 190 before returning to its starting position.

As weaving further progresses along the fabric 186, the size and location of the common warp zone may change, as the yarns of third woven segment 202 include a decreased common warp zone that is different from the primary intermediate warp zone 190, such as the secondary intermediate warp zone 214. In this example, the zonal weaving system 184 may be configured to wrap a secondary intermediate warp zone 214 having a number of warp yarns assigned to the third woven segment 202, such as two warp yarns. The exemplary third woven segment 202 may be woven adjacent the second woven segment 200, with the first weft yarn 208 being carried through the third portion 212 via the first carrier (e.g., the same first carrier that transported the first weft yarn 196 and first weft yarn 204). Additionally, the first carrier may be configured to wrap the first weft yarn 208 around the second intermediate warp zone 214 before returning to a starting position. The second weft yarn 210 may be woven through the fourth portion 216 of warp yarns and wrapped around the second intermediate warp zone 214 by the second carrier before returning to a starting position.

As such, a fabric 186 may include pairs of first and second weft yarns along multiple segments of the fabric body that either maintain or change the width of the intermediate warp zones. In the example of FIG. 15, the change in width of the intermediate warp zone includes a shift from a three-yarn primary intermediate warp zone 190 to a two-yarn secondary intermediate warp zone 214. In further aspects, the number of intermediate warp zone yarns may stay the same between adjacent portions of the fabric, may change between adjacent portions of the fabric by increasing or decreasing in width, and may be woven with corresponding adjustments in the widths of the neighboring warp yarn portions (i.e., 188, 192, 212, and 216). During wrapping of the dynamic, intermediate warp zone, the weft yarns may also be configured to wrap and interlock with opposing weft yarn pairs before returning to a starting point/origin. In one example, the interlocking of weft yarn pairs may also be variable, such as an interlocked weft yarn pair occurring at a particular interval along a woven material, such as a common wrap zone where pairs of weft yarns interlock every five weaving rows.

In one aspect, a first carrier may be used to variably deliver the first weft yarns (196, 204, and 208) and a second carrier may be used to variably deliver the second weft yarn (198, 206, and 210), with the zonal weaving system 184 generating a shifting width of the primary intermediate warp zone 190 and any subsequent and/or secondary intermediate warp zones 214, and a corresponding shift in width of the neighboring third portion 212 and fourth portion 216 of warp yarns adjacent the secondary intermediate warp zone 214.

With continued reference to FIG. 15, during weaving of the first woven segment 194, the first weft yarn 196 may be woven through the first portion 188, via a first carrier, at the same time, before, or after weaving of the second weft yarn 198 through the second portion 192, via a second carrier. Based on the order of weaving through the fabric 186, the first weft yarn 196 and the second weft yarn 198 may be wrapped around the primary intermediate warp zone 190 at the same time, or with one yarn wrapped before the other. As noted above, the wrapping of the primary intermediate warp zone 190 may further include an interlocking of the first weft yarn 196 and the second weft yarn 198 before, during, or after the yarns are wrapped around the primary intermediate warp zone 190, before returning to their respective yarn origin, such as on a selvedge edge of the fabric 186 or at an alternate location with respect to the woven material.

Figure 16:
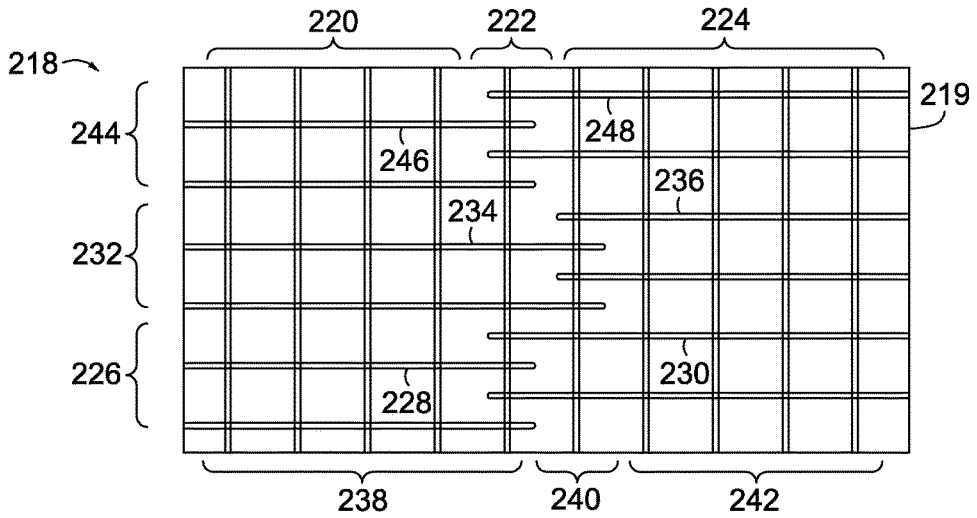
FIG. 16 is a top view of exemplary zonal weaving system components, in accordance with aspects.

Turning next to FIG. 16, a top view of an exemplary zonal weaving system 218 depicts a fabric 219 with warp yarns including a first portion 220, a primary intermediate warp zone 222, and a second portion 224. During weaving within the first woven segment 226, in some aspects, the intermediate warp zone 222 may be wrapped by alternating pairs of the first weft yarns 228 and second weft yarns 230. Upon shifting the primary intermediate warp zone 222 to a secondary intermediate warp zone 240, the second woven segment 232 may be woven to include first weft yarns 234 and second weft yarns 236 woven through the third portion 238 and fourth portion 242 of the fabric 219. A further zonal shift may take place between the second woven segment 232 and the third woven segment 244, with the primary intermediate warp zone 222 including first weft yarns 246 and second weft yarns 248, and a corresponding shift in adjacent warp yarns (i.e., changing from third portion 238 back to first portion 220, and from fourth portion 242 back to second portion 224).

In the example of FIG. 16, while maintaining consistent dimensions of the fabric 219, the first and second warp yarns of adjacent portions may alternate which portions of warp yarns are woven with which weft yarns according to the size of the adjacent intermediate warp zone throughout the fabric 219. As such, while maintaining a consistent width of a common warp zone, such as the single-yarn common warp zone, an amount of tension may be maintained across multiple dimensions of the fabric 219, including an amount of tension with respect to the weft direction of opposing pairs of yarns alternating in the example of FIG. 16. In further examples, an amount of tension may be maintained within a woven material by adjusting a position of an intermediate warp zone between single or multiple rows of weaving, a number of warp yarns in the intermediate warp zone between single or multiple rows of weaving, or a combination of both warp zone position and warp zone width, thereby balancing an amount of tension created within the overall fabric while increasing, decreasing, and/or repositioning zonal woven features to provide a desired function within the fabric.

Figure 17:
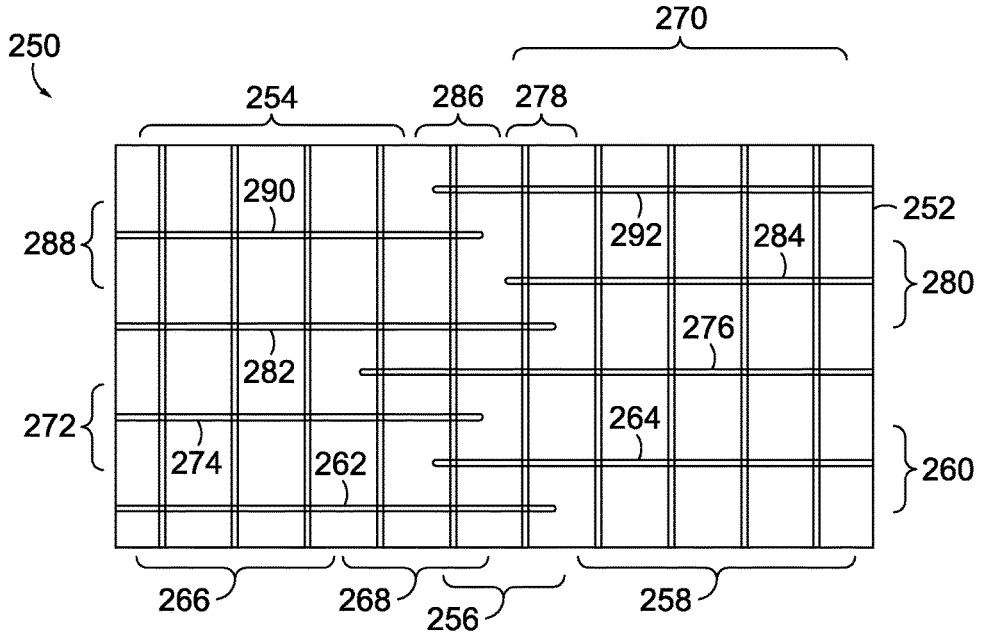
FIG. 17 is a top view of exemplary zonal weaving system components, in accordance with aspects.

With reference to the exemplary zonal weaving system 250 of FIG. 17, the fabric 252 includes a first portion 254, a primary intermediate warp zone 256, a second portion 258, and a first woven segment 260 including a first weft yarn 262 and a second weft yarn 264. In the second woven segment 272, the common warp zone is shifted to provide a secondary intermediate warp zone 268, with an adjacent third portion 266 and a fourth portion 270. With respect to the third woven segment 280, in some aspects, the common warp zone is shifted again to a new location within the fabric 252 and decreased to include one common warp yarn (compared to the two warp yarns in primary intermediate warp zone 256 and secondary intermediate warp zone 268), with the tertiary intermediate warp zone 278 adjacent the combined warp yarns of the third portion 266 and secondary intermediate warp zone 268, as well as the warp yarns of second portion 258. Additionally, the decreased, tertiary intermediate warp zone 278 may be shifted again to a quaternary intermediate warp zone 286 in the fourth woven segment 288. Additionally, as shown in the fourth woven segment 288, the adjacent warp yarns of first portion 254 and fourth portion 270 may be adjusted to correspond to the weaving and wrapping of first yarn 290 and second yarn 292.

In the various examples of FIG. 17, the first weft yarns 262, 274, 282, and 290 are woven according to a corresponding width of the intermediate warp zone of each row, while the paired second weft yarns 264, 276, 284, and 292 provide a corresponding change that maintains the width of the fabric 252 while the intermediate warp zone changes in size and location. In some aspects, the intermediate warp zone may shift in location along a single or multiple rows of a woven material, and may change to include a consistent and/or a varying number of warp yarns that alter a width of the common warp zone, such as the one-yarn and two-yarn shifting intermediate woven zone in the example of FIG. 17.

Figure 18:
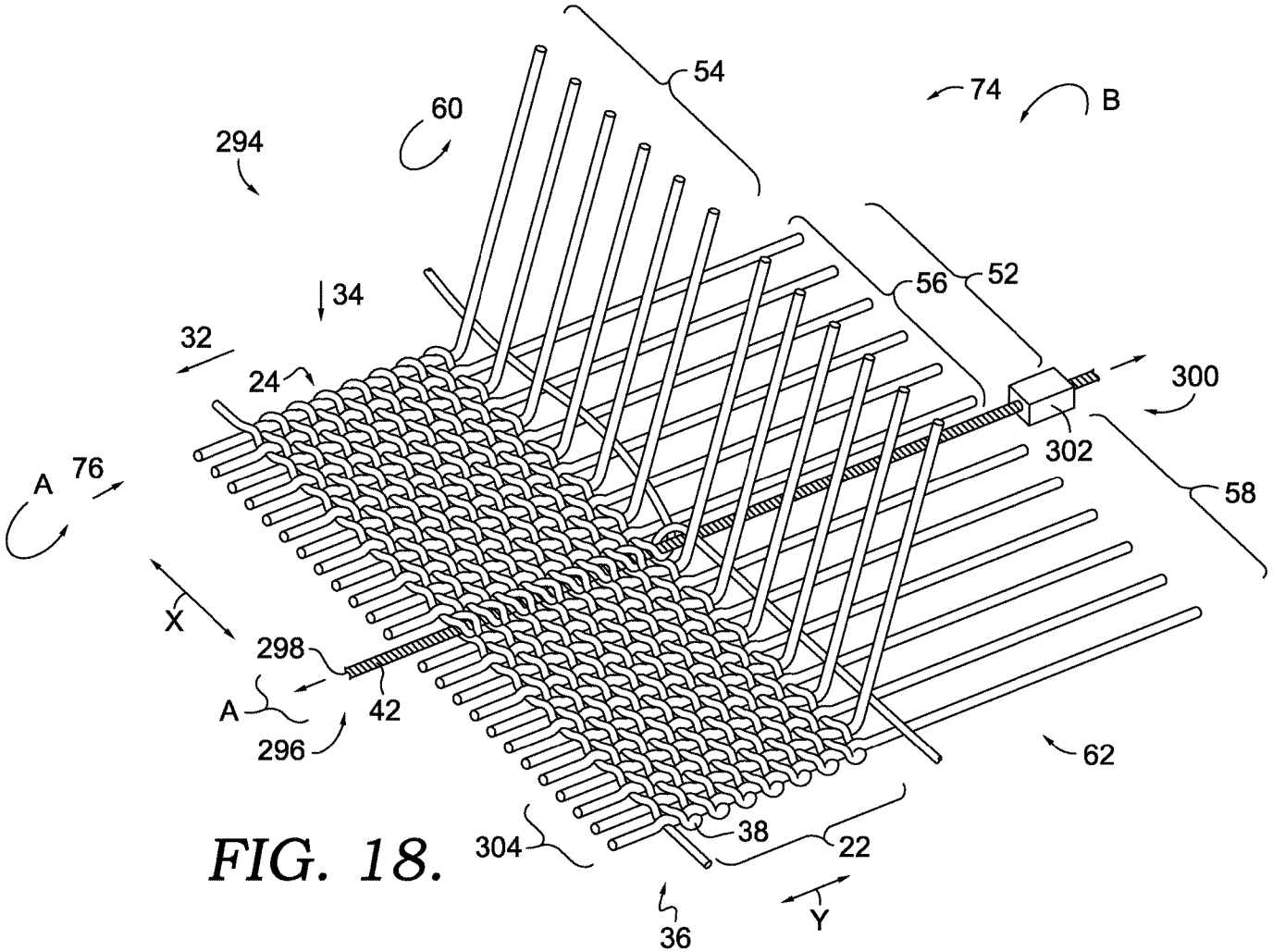
FIG. 18 is a perspective view of an exemplary double-carrier, zonal weaving system having a warp-zone tension adjustment mechanism, in accordance with aspects.
Figure 19:
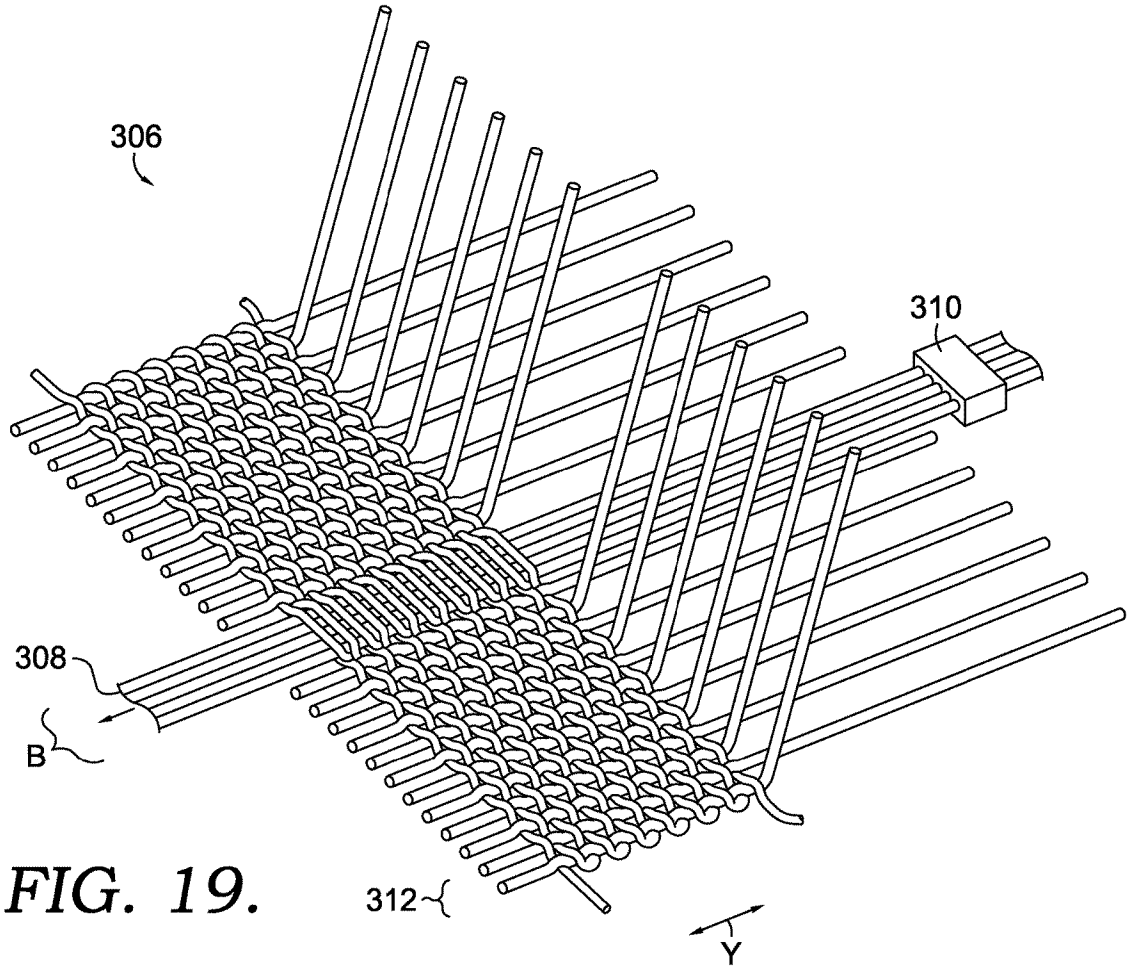
FIG. 19 is a perspective view of an exemplary double-carrier, zonal weaving system having a warp-zone tension adjustment mechanism, in accordance with aspects.

Referring next to FIG. 18, a perspective view of an exemplary double-carrier, zonal weaving system 294 having a warp zone front end 298 at a first end 296 of a woven fabric 304, and a warp-zone tension adjustment mechanism 302 at a second end 300 of the woven fabric 304. As such, an amount of tension maintained with respect to the intermediate warp yarn 42 may be adjusted using the warp-zone tension adjustment mechanisms 302 with respect to the stationary warp zone front end 298 (i.e., the portion of the intermediate warp zone already woven into the woven fabric 304), to maintain a consistent woven structure along the body of the woven fabric 304. Similarly, in the example of FIG. 19, an exemplary double-carrier, zonal weaving system 306 includes a warp zone front end 308 opposite a warp-zone tension adjustment mechanism 310. Using an amount of tension applied to the tension adjustment mechanisms 308, with respect to the stationary warp zone front end 308, the woven fabric 312 may maintain one or more consistent material properties while integrating zonal woven features, such as a fabric tension, feel, stretch, surface characteristics, zonal characteristics, and the like, during wrapping both first and second weft yarns around a stationary and/or dynamic, intermediate warp zone.

Figure 20:
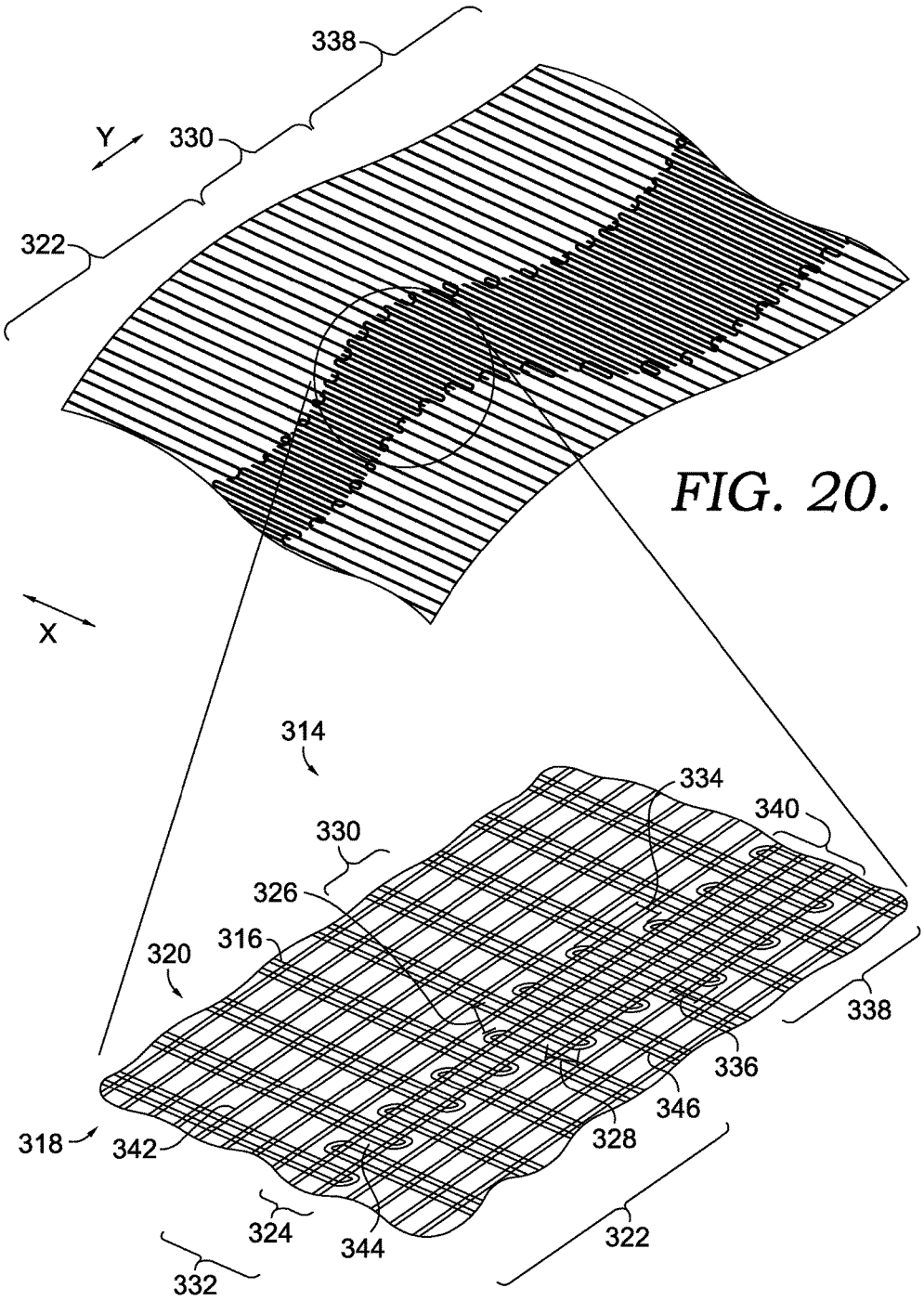
FIG. 20 is an exemplary double-carrier, zonal woven material with an expanded view of a portion of an exemplary wrap zone, in accordance with aspects.

In FIG. 20, an exemplary double-carrier, zonal woven material 314 includes an enlarged woven fabric 320 having a plurality of weft yarns 316 and a plurality of warp yarns 342 with an intermediate warp zone 344 that varies throughout the woven fabric 320. In one aspect, the intermediate warp zone 344 includes multiple widths along the y-axis of the woven fabric 320, starting at a first end 318 of the example in FIG. 20. A first intermediate warp zone 324 includes a plurality of first carrier and second carrier weft yarns in the first woven segment 322. After a change in width of the intermediate warp zone 324, by a first warp increase 326 and a second warp increase 328, the second woven segment 330 includes an intermediate warp zone 332 covering a greater number of warp yarns than the previous intermediate warp zone 324. In other words, while weaving along the woven fabric 320, the first carrier and second carrier weft yarns are wrapped around a first intermediate warp zone within the first woven segment 322, and are woven around a second intermediate warp zone within the second woven segment 330.

In further aspects, the intermediate warp zone 344 may shift in location with respect to the woven fabric while maintaining a common width of the double-wrapped zone. For example, the third woven segment 338 of FIG. 20 includes a third intermediate warp zone 340 having a warp shift 334 that changes a location of the third intermediate warp zone 340 without changing the number of warp yarns currently being wrapped by both first and second weft yarns, as part of the intermediate warp zone 344 structure.

Figure 21:
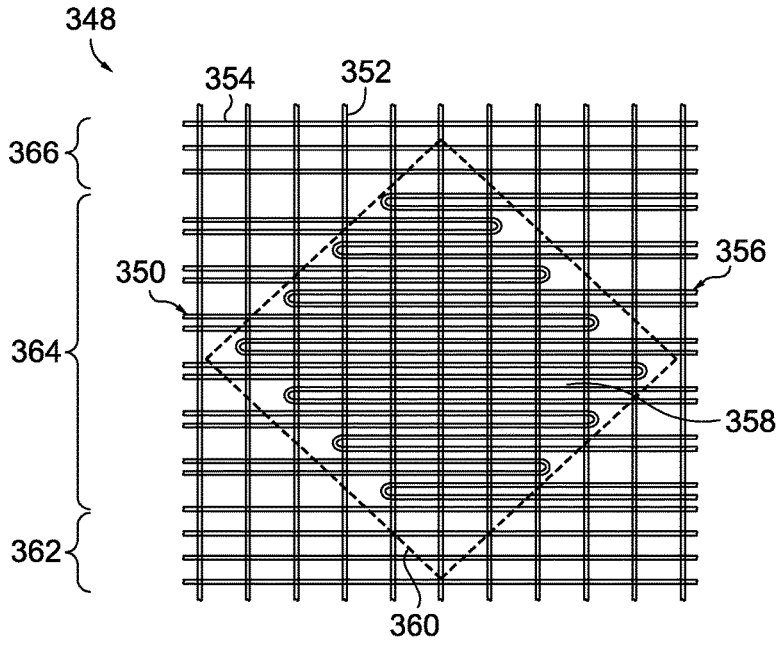
FIG. 21 is an exemplary top view of a double-carrier, zonal woven material, in accordance with aspects.

Turning next to FIG. 21, a perspective view of a double-carrier, zonal woven material 348 is depicted in accordance with various aspects. The exemplary woven material 348 surrounds the intermediate warp zone 360 (identified by dashed lines around a border of the intermediate warp zone 360) and includes a first woven segment 366 having a plurality of warp yarns 352 with weft yarns 354 carried across the entire width of the woven material 348. Further, the second woven segment 364 may include a plurality of first weft yarns 350 and second weft yarns 356 that are active on only a portion of the woven material 348, as each weft yarn wraps the warp yarns of the common intermediate warp zone 360 and returns to the weft yarn origin. In other words, first weft yarns 350 are woven through a portion of the warp yarns before returning to the starting position for the first weft yarn 350. Further, second weft yarns 356 are woven through a portion of the warp yarns before returning to the starting position for the second weft yarn 356. Based on changing a number and/or position of the warp yarns 352 doubly wrapped in the intermediate warp zone 360, the second woven segment 364 includes an enhanced, integrated woven zone 358 and/or varying woven texture within the woven material 348. In the third woven segment 362, the warp yarns 352 are woven with weft yarns 354 to provide a woven material 348 having an integrated woven zone 358 embedded within the structure and enabled based on first and second carriers of the weft yarns according to a particular arrangement of first, second, and third woven segments 366, 364, and 362.

Figure 22:
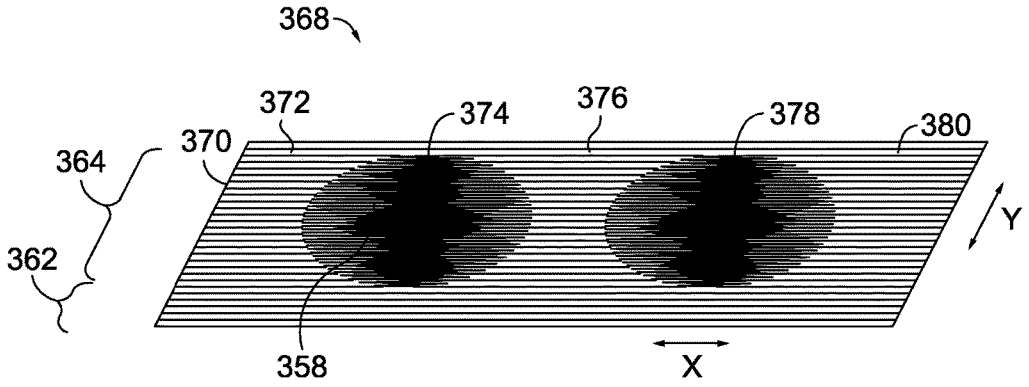
FIG. 22 is a perspective view of a double-carrier, zonal woven material, in accordance with aspects.

In FIG. 22, a double-carrier, zonal woven material 368 includes a fabric 370 with a surrounding woven material 372, a first intermediate warp zone 374, and a second intermediate warp zone 378. As such, the integrated woven zones 358 within the woven material 372 provide enhanced portions of the zonal woven material 372, adding such characteristics as enhanced durability, thickness, varied texture, bulky appearance, ornamental design, reinforced structure, contoured shaping, and/or other characteristics provided by the dual-wrapped zone having common warp threads and overlapping and/or interlocking weft yarns. In some aspects, multiple weft yarns may be inserted into various portions of a specific zone within a material, providing a pattern of individual intermediate warp zones across the material. For example, while third woven segment 362 included weft yarns carried across the x-axis, the second woven segment 364 includes the insertion of multiple weft yarns within a single row of the woven material 368. In some instances, the insertion of multiple weft yarns is used to generate multiple intermediate warp zones within a fabric 370.

As indicated in the chart 2300 shown in FIG. 23, a series of active and inactive weft yarn insertions may occur across an x-axis of the fabric 370 to provide the selective, zonal characteristics of FIG. 22, in some aspects. In this example, a first weft yarn A is represented by an active weaving state "A" and an active zonal weaving state "A," while a second weft yarn B is represented by an active weaving state "B," and an active zonal weaving state "B." In this example, the first zone includes both active zonal weaving states within the second through fifth rows. In further aspects, an inactive yarn is represented by a lowercase indicator, such as the inactive weaving state "b." In one example, an inactive weaving state of a yarn may refer to a yarn that is carried across the material, but not interwoven with either the yarns of the upper or lower sheds. Additionally, the first weft yarn A is depicted in the chart below as returning to a point of origin using a direction indicator "←," while the second weft yarn B is depicted as returning to a point of origin using a direction indicator "→."

In some aspects, active and inactive weft yarns may vary across multiple rows of a woven material, providing zonal characteristics corresponding to particular parts of the material when in an as-worn configuration, such as the upper portion of a woven shoe or the shoulder portion of an athletic jersey. As such, the zonal characteristics may be targeted to a particular portion of the garment, using active/engaged weft yarns and wrapped warp zones where needed for particular structure and/or visual effect. At the same time, those locations not corresponding to a particular feature may omit active yarns and/or disengage particular structures from the overall weaving. In the chart 2300 shown in FIG. 23, the row 1 includes only active weft yarn A, as there are no zonal characteristics within the first row of weaving and no additional weft yarns incorporated to provide a zonal function. Once two zones are introduced in row 2, in one example, the weft yarn A is woven across a surrounding warp shed, and through the active zonal feature ("A") as well as through the intermediate zone ("A") to provide a connection between the first and second zonal features by the yarn A. Once bridging between the two warp zones, the active zonal feature "A" is woven with the second zonal feature before returning ("←") to a starting position. In further aspects, the second weft yarn B is active across the surrounding warp shed ("B"), and engaged through as an active zonal feature ("B") while remaining inactive ("b") in the intermediate zone between the first and second zonal feature, as shown in the example above. In another aspect, the second weft yarn "b" floats or is carried through the intermediate zone such that the second weft yarn is not engaging the material between the two zonal features.

Although depicted in chart 2300 of FIG. 23 as including two weft yarns, having active and inactive placement across the width of a woven material, additional yarns may be incorporated into a multiple-carrier zonal woven system, such as a third carrier of a third yarn that alternates between zones of active and inactive weaving status. As such, in some aspects, as shown in chart 2400 of FIG. 24, an additional weft yarn may be incorporated in the multi-carrier, zonal weaving system to provide a particular woven feature throughout the material, such as a transition zone between two zonal features. In chart 2400, a third yarn C is represented by an active weaving state "C" and an active zonal weaving state "C." Further, while the first zone includes both active zonal weaving states of yarns A and C, the second zone includes active zonal weaving states of yarns C and B.

In further aspects, a first weft yarn from a first origin and a second weft yarn from a second origin may overlap at one or more locations in a woven material to provide location-specific zonal weaving characteristics. In further examples, a first, second, and third weft yarn may be woven to provide a zonal woven material having minimal waste between zonal features having shared rows within the material. In some aspects, multiple yarns may remain disengaged and/or inactive within particular portions of the woven material, such that waste is minimized when maintaining multiple yarns coupled to the zonal woven material.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

As used herein and in connection with the claims listed hereinafter, the terminology "any of claims" or similar variations of said terminology is intended to be interpreted such that features of claims may be combined in any combination. For example, an exemplary claim 4 may indicate the method/apparatus of any of claims 1 through 3, which is intended to be interpreted such that features of claim 1 and claim 4 may be combined, elements of claim 2 and claim 4 may be combined, elements of claims 3 and 4 may be combined, elements of claims 1, 2, and 4 may be combined, elements of claims 2, 3, and 4 may be combined, elements of claims 1, 2, 3, and 4 may be combined, and/or other variations. Further, the terminology "any of claims" or similar variations of said terminology is intended to include "any one of claims" or other variations of such terminology, as indicated by some of the examples provided above.

What is claimed is:

1. A zonal weaving device for providing a zonal woven material, the zonal weaving device comprising:

a first carrier on a first side of the zonal weaving device, said first carrier configured to carry a first weft yarn from the first side of the zonal weaving device; and a second carrier on a second side of the zonal weaving device, said second carrier configured to carry a second weft yarn from the second side of the zonal weaving device, wherein the first side of the zonal weaving device is opposite the second side of the zonal weaving device, wherein the zonal woven material comprises a first plurality of warp yarns, one or more intermediate warp yarns, and a second plurality of warp yarns, wherein in a first woven row, the first carrier is configured to carry the first weft yarn through a first shed formed from the first plurality of warp yarns to the one or more intermediate warp yarns and wrap around the one or more intermediate warp yarns before returning the first weft yarn to the first side in a second woven row, and wherein in the first woven row, the second carrier is configured to carry the second weft yarn through a second shed formed from the second plurality of warp yarns to the one or more intermediate warp yarns and also wrap around the one or more intermediate warp yarns before returning the second weft yarn to the second side in the second woven row, wherein the one or more intermediate warp yarns are located in between the first plurality of warp yarns and the second plurality of warp yarns forming the woven material.

2. The zonal weaving device of claim 1, wherein the first carrier comprises a first rapier and the second carrier comprises a second rapier.

3. The zonal weaving device of claim 1, wherein the first shed formed from the first plurality of warp yarns comprises an upper plurality of warp yarns and a lower plurality of warp yarns.

4. The zonal weaving device of claim 3, wherein the upper plurality of warp yarns and the lower plurality of warp yarns of the first shed are independently moveable with respect to the first shed and the intermediate warp yarns.

5. The zonal weaving device of claim 1, wherein the second shed formed from the second plurality of warp yarns comprises an upper plurality of warp yarns and a lower plurality of warp yarns.

6. The zonal weaving device of claim 5, wherein the upper plurality of warp yarns and the lower plurality of warp yarns of the second shed are independently moveable with respect to the second shed and the intermediate warp yarns.

7. The zonal weaving device of claim 1, wherein wrapping around the one or more intermediate warp yarns with the first weft yarn via the first shed and the second weft yarn via the second shed comprises interlocking the first weft yarn and the second weft yarn.

8. The zonal weaving device of claim 1, wherein the one or more intermediate warp yarns form a common warp zone, said common warp zone being adjustable based on one or more of:

1) a number of warp yarns in the common warp zone;
2) a number of warp yarns in the first plurality of warp yarns forming the first shed; and
3) a number of warp yarns in the second plurality of warp yarns forming the second shed.

9. A zonal weaving method for generating a woven material having a common woven zone comprising:

in a first woven row, receiving a first weft yarn from a first side of a weaving loom, said first weft yarn received via a first shed portion comprising a plurality of first upper warp yarns and a plurality of first lower warp yarns;

wrapping the first weft yarn around one or more zonal warp yarns in a first direction;

exchanging a first position of the plurality of first upper warp yarns with a second position of the plurality of first lower warp yarns;

returning the first weft yarn to the first side of the weaving loom without the first weft yarn reaching a second side of the weaving loom in a second woven row;

in the first woven row, receiving a second weft yarn from the second side of the weaving loom, said second weft yarn received via a second shed portion comprising a plurality of second upper warp yarns and a plurality of second lower warp yarns;

wrapping the second weft yarn around the one or more zonal warp yarns in a second direction;

exchanging a third position of the plurality of second upper warp yarns with a fourth position of the plurality of second lower warp yarns; and returning the second weft yarn to the second side of the weaving loom without the second weft yarn reaching the first side of the weaving loom in the second woven row.

10. The zonal weaving method of claim 9, wherein the first direction is opposite the second direction.

11. The zonal weaving method of claim 9, wherein wrapping the second weft yarn around the one or more zonal warp yarns comprises interlocking the second weft yarn with the first weft yarn.

12. The zonal weaving method of claim 9, wherein the common woven zone comprises the one or more zonal warp yarns wrapped by the first weft yarn and the second weft yarn at alternating rows of weaving.

13. The zonal weaving method of claim 12, wherein each row of weaving comprises the first shed portion receiving the first weft yarn and the second shed portion receiving the second weft yarn.

14. A zonal woven material comprising:

a first woven portion comprising a plurality of first warp yarns and a first weft yarn;

a second woven portion comprising a plurality of second warp yarns and a second weft yarn;

an intermediate woven zone located between the first woven portion and the second woven portion abutting the first woven portion on a first side of the intermediate woven zone, and abutting the second woven portion on a second side of the intermediate woven zone, wherein the intermediate woven zone comprises one or more intermediate warp yarns wrapped by both, the first weft yarn and the second weft yarn in the same woven row.

15. The zonal woven material of claim 14, wherein an overall material width of the zonal woven material comprises a first width across the first woven portion, a second width across the second woven portion, and a third width across the intermediate woven zone.

16. The zonal woven material of claim 14, wherein the overall material width of the zonal woven material is a constant width based on a dynamic width of one or more of the first woven portion and the second woven portion corresponding to a dynamic width of the intermediate woven zone.

17. The zonal woven material of claim 14, wherein the first weft yarn and the second weft yarn are interlocked at the intermediate woven zone.

* * * * *